US010073405B2

(12) United States Patent
Kawasaki et al.

(10) Patent No.: US 10,073,405 B2
(45) **Date of Patent: *Sep. 11, 2018**

(54) IMAGE FORMING APPARATUS

(71) Applicant: FUJI XEROX CO., LTD., Tokyo (JP)

(72) Inventors: Akihiro Kawasaki, Kanagawa (JP); Hirofumi Nakamura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/358,378

(22) Filed: Nov. 22, 2016

(65) Prior Publication Data

US 2017/0351210 A1 Dec. 7, 2017

(30) Foreign Application Priority Data

Jun. 2, 2016 (JP) ..... 2016-111266

(51) Int. Cl.

| | |
|---|---|
| ***G03G 15/16*** | (2006.01) |
| ***G03G 5/14*** | (2006.01) |
| ***G03G 15/00*** | (2006.01) |
| ***G03G 5/04*** | (2006.01) |

(52) U.S. Cl.
CPC ..... *G03G 15/75* (2013.01); *G03G 5/04* (2013.01); *G03G 5/142* (2013.01); *G03G 5/144* (2013.01); *G03G 15/1605* (2013.01)

(58) Field of Classification Search
CPC .... G03G 5/144; G03G 5/142; G03G 15/1675; G03G 15/1605; G03G 15/75
USPC ..... 430/64, 65
See application file for complete search history.

(56) References Cited

U.S. PATENT DOCUMENTS 7,498,107 B2 * 3/2009 Takegawa ..... G03G 15/5033 399/12
8,802,337 B2 * 8/2014 Kawasaki ..... G03G 5/144 399/111

FOREIGN PATENT DOCUMENTS

JP 2003-91132 A 3/2003

* cited by examiner

*Primary Examiner* — Janis L Dote
(74) *Attorney, Agent, or Firm* — Sughrue Mion, PLLC

(57) ABSTRACT

An image forming apparatus includes: an electrophotographic photoreceptor that includes an electroconductive substrate, an undercoat layer which is provided on the electroconductive substrate and has electrostatic capacitance per unit area of from $2.5\times10^{-11}$ F/cm$^2$ to $2.5\times10^{-10}$ F/cm$^2$, and a photosensitive layer provided on the undercoat layer; a charging unit; an electrostatic latent image forming unit; a developing unit; an intermediate transfer member; a primary transfer unit that primarily transfers the toner image formed on the surface of the electrophotographic photoreceptor, onto the surface of an intermediate transfer member, while providing a primary transfer current value of from 80 μA to 160 μA; and a secondary transfer unit that secondarily transfers the toner image transferred onto the surface of the intermediate transfer member, onto a surface of a recording medium.

13 Claims, 4 Drawing Sheets

IMAGE FORMING APPARATUS

CROSS-REFERENCE TO RELATED APPLICATIONS

This application is based on and claims priority under 35 USC 119 from Japanese Patent Application No. 2016-111266 filed Jun. 2, 2016.

BACKGROUND

1. Technical Field

The present invention relates to an image forming apparatus.

2. Related Art

In the related art, an apparatus for sequentially performing charging, forming an electrostatic latent image, developing, transferring, cleaning, and the like by using an electrophotographic photoreceptor is widely known as an electrophotographic image forming apparatus.

SUMMARY

According to an aspect of the invention, there is provided an image forming apparatus including:

an electrophotographic photoreceptor which includes an electroconductive substrate, an undercoat layer which is provided on the electroconductive substrate and has electrostatic capacitance per unit area of from $2.5\times10^{-11}$ F/cm$^2$ to $2.5\times10^{-10}$ F/cm$^2$, and a photosensitive layer provided on the undercoat layer;

a charging unit that charges a surface of the electrophotographic photoreceptor;

an electrostatic latent image forming unit that forms an electrostatic latent image on a charged surface of the electrophotographic photoreceptor;

a developing unit that develops the electrostatic latent image formed on the surface of the electrophotographic photoreceptor by using a developer containing a toner, so as to form a toner image;

an intermediate transfer member of which the toner image formed on the surface of the electrophotographic photoreceptor is transferred onto a surface;

a primary transfer unit that primarily transfers the toner image formed on the surface of the electrophotographic photoreceptor, onto the surface of the intermediate transfer member, and provides a primary transfer current value of from 80 μA to 160 μA; and a secondary transfer unit that secondarily transfers the toner image transferred onto the surface of the intermediate transfer member, onto a surface of a recording medium.

BRIEF DESCRIPTION OF THE DRAWINGS

Exemplary embodiments of the present invention will be described in detail based on the following figures, wherein.

DETAILED DESCRIPTION

Figure 1:
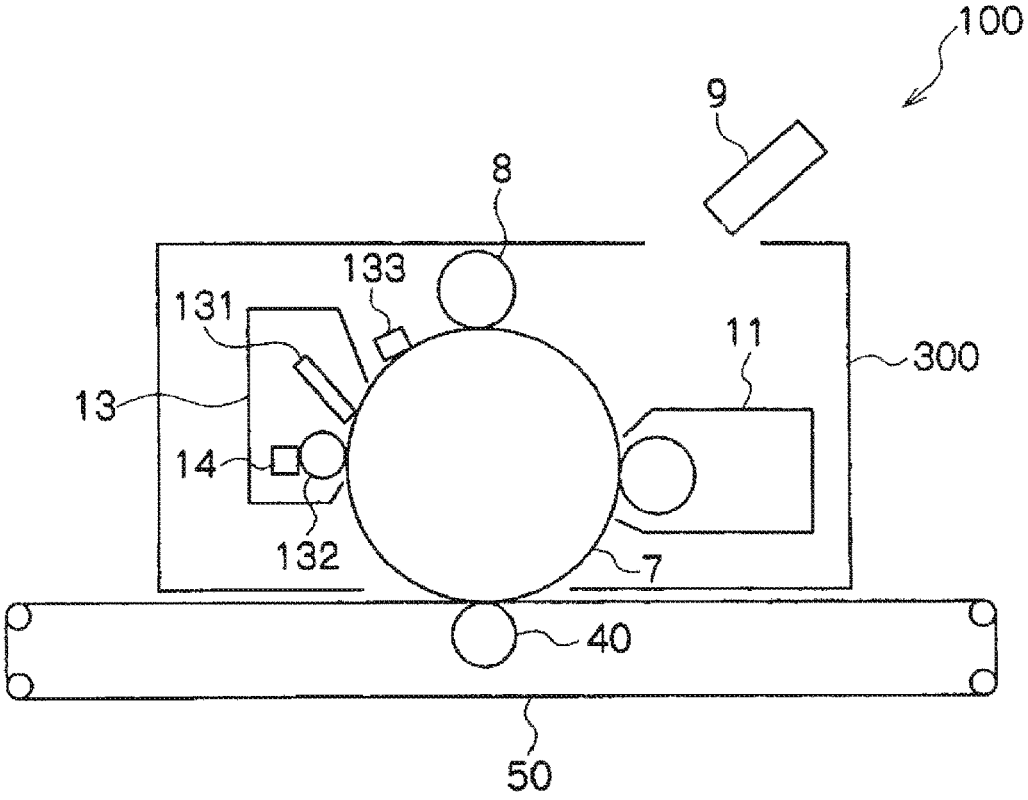
FIG. 1 is a schematic configuration diagram illustrating an example of an image forming apparatus according to an exemplary embodiment.

Hereinafter, an exemplary embodiment as an example of the present invention will be described in detail.

Image Forming Apparatus

According to the exemplary embodiment, an image forming apparatus includes an electrophotographic photoreceptor, a charging unit that charges a surface of the electrophotographic photoreceptor, an electrostatic latent image forming unit that forms an electrostatic latent image on the charged surface of the electrophotographic photoreceptor, a developing unit that develops the electrostatic latent image formed on the surface of the electrophotographic photoreceptor by using a developer containing a toner, so as to form a toner image, an intermediate transfer member of which the toner image formed on the surface of the electrophotographic photoreceptor is transferred onto a surface, a primary transfer unit that primarily transfers the toner image formed on the surface of the electrophotographic photoreceptor, onto the surface of the intermediate transfer member, and a secondary transfer unit that secondarily transfers the toner image transferred onto the surface of the intermediate transfer member, onto a surface of a recording medium.

The electrophotographic photoreceptor (simply also referred to "a photoreceptor" below) includes an electroconductive substrate, an undercoat layer provided on the electroconductive substrate, and a photosensitive layer provided on the undercoat layer. In the undercoat layer, electrostatic capacitance per unit area is from $2.5\times10^{-11}$ F/cm$^2$ to $2.5\times10^{-10}$ F/cm$^2$.

The primary transfer current value in the primary transfer unit is from 80 μA to 160 μA.

Here, "the primary transfer current value" indicates a current value of a transfer current which flows in the photoreceptor from the primary transfer unit when a toner image is transferred to an intermediate transfer member from the photoreceptor.

In the image forming apparatus according to the exemplary embodiment, if the electrostatic capacitance per unit area of the undercoat layer and the primary transfer current value in the primary transfer unit are in the above ranges, occurrence of a residual image phenomenon (also referred to as "ghost" below) by remaining of a history of the previous image is prevented. The reason is unclear, but is supposed as follows.

In the conventional intermediate-transfer type image forming apparatus, in a case where an image is formed at a high speed (for example, a speed of transporting a recording mediumis from 400 mm/s to 600 mm/s), transfer (primary transfer) of a toner image from the photoreceptor to the intermediate transfer member is performed for a short term. Thus, poor transfer due to an insufficient transfer current is easily caused. If the poor transfer in the primary transfer occurs, image defects (poor image density) due to the poor transfer occur in an obtained image.

As a method of preventing the poor transfer in the primary transfer, a method in which the primary transfer current value is set to be large in order to address insufficiency of the transfer current is considered. However, if the primary transfer current value is set to be large, a transfer current occurring by a transfer voltage applied to the primary transfer unit in the process of the primary transfer flows in the photoreceptor. Thus, when the next image is formed, the residual image phenomenon (ghost) in which history of the previous image remains easily occurs.

It is supposed that the ghost occurs by the following causes. Specifically, for example, electric resistance between the photoreceptor and the primary transfer unit corresponds to the sum of electric resistance of the intermediate transfer member and electric resistance of the toner image at an image portion. On the contrary, the electric resistance between the photoreceptor and the primary transfer unit corresponds to only the electric resistance of the intermediate transfer member at a non-image portion. That is, the electric resistance at the non-image portion at which a toner image is not provided is smaller than that at the image portion at which the toner image is provided. Thus, the primary transfer current intensively flows in the non-image portion of the photoreceptor, and many charges are easily accumulated. As described above, if the next image is formed in a state where a difference in an amount of accumulated charges occurs largely between the image portion and the non-image portion, many charges having an opposite polarity of a charged potential are accumulated in the non-image portion of the previous image when a charging process is performed. Accordingly, surface charges are cancelled, and thus poor charging is easily caused. As a result, it is supposed that the non-image portion in the previous image is expressed as a history image of the previous image in the next image, and thus the ghost occurs.

The ghost remarkably occurs particularly in an image forming apparatus in which a multi-color image is formed.

For example, in a so-called tandem type multi-color image forming apparatus, an image forming unit which corresponds to toner images of each color is provided. Toner images formed on the photoreceptors in image forming units are sequentially transferred so as to superimpose each other on one intermediate transfer member. At this time, when a toner image of a first color is primarily transferred, as described above, the toner image is provided in the image portion. Thus, a resistance difference (resistance difference of the first color) may occur between the image portion and the non-image portion, and the ghost due to the resistance difference between the image portion and the non-image portion may occur.

The primary transfer of toner images of the second color and the subsequent colors is performed on the intermediate transfer member after the toner image of the first color has been already transferred. Thus, toner images of plural colors may overlap each other. If there is a region in which toner images of plural colors overlap each other (also referred to as "a multiple-color region" below), a toner image provided between the photoreceptor and the primary transfer unit during the primary transfer is thick in the multiple-color region. Thus, a resistance difference which is larger than resistance difference of the first color occurs between the multiple-color region and the non-image portion. Thus, in the image forming units which respectively correspond to the toner images of the second color and the subsequent colors, it is considered that, among types of ghost, particularly, ghost (multiple-color ghost) due to the resistance difference between the multiple-color region and the non-image portion easily occurs.

This is not limited to the tandem type multi-color image forming apparatus. For example, even in a rotary type multi-color image forming apparatus, if there is the multiple-color region, the resistance difference largely occurs between the multiple-color region and the non-image portion. Thus, it is considered that similar multiple-color ghost may occur.

On the contrary, in the exemplary embodiment, the electrostatic capacitance per unit area of the undercoat layer is set to be in the above range. Thus, even when an image is formed at a high speed in a state of the primary transfer current value is set to be in the above range, the occurrence of ghost (including the multiple-color ghost, in addition to the ghost for one color) is prevented.

Specifically, the electrostatic capacitance per unit area of the undercoat layer is set to be in the above range which is smaller than that in the related art. Thus, it is difficult to cause the undercoat layer to store charges. Even when the transfer current flows into the photoreceptor from the primary transfer unit in the process of the primary transfer, inflow charges easily flow toward the electroconductive substrate side. Because the inflow charges and charges having an opposite polarity easily move in the undercoat layer, the inflow charges and the charges of the opposite polarity cancel each other, and thus are easily removed. As a result, it is considered that an amount of charges accumulated on the photoreceptor is reduced at a time point when the next image formation is started. Accordingly, in the next image formation, it is difficult to cause poor charging occurring by many charges accumulated only in a specific region. Thus, it is supposed that the occurrence of ghost is difficult.

With the above reason, it is supposed that the electrostatic capacitance per unit area of the undercoat layer is set to be from $2.5\times10^{-11}$ F/cm$^2$ to $2.5\times10^{-10}$ F/cm$^2$, and the primary transfer current value in the primary transfer unit is set to be from 80 μA to 160 μA in the intermediate-transfer type image forming apparatus, and thus the image forming apparatus according to the exemplary embodiment prevents the occurrence of ghost.

The prevention of the occurrence of ghost may be also achieved, for example, by decreasing the recording medium transport speed or by increasing a diameter of the photoreceptor. However, in the exemplary embodiment, as described above, the electrostatic capacitance per unit area of the undercoat layer is set to be from $2.5\times10^{-11}$ F/cm$^2$ to $2.5\times10^{-10}$ F/cm$^2$, and the primary transfer current value in the primary transfer unit is set to be from 80 μA to 160 μA, and thus the prevention of the occurrence of ghost is achieved. Thus, the recording medium transport speed is set to be equal to or higher than 400 mm/s, and thus an image forming apparatus with a high speed and with the occurrence of ghost prevented is obtained. The diameter of the photoreceptor is set to be 84 mm or less, and thus an image forming apparatus with a small type (compact) and with the occurrence of ghost prevented is obtained.

The recording medium transport speed is preferably from 400 mm/s to 600 mm/s, more preferably from 460 mm/s to 600 mm/s, and further preferably from 500 mm/s to 600 mm/s.

The diameter of the photoreceptor is preferably from 24 mm to 84 mm, more preferably from 30 mm to 84 mm, and further preferably from 40 mm to 84 mm.

Here, as the image forming apparatus according to the exemplary embodiment, a well-known image forming apparatus as follows is applied: an apparatus which includes a fixing unit configured to fix a toner image transferred onto a surface of a recording medium; an apparatus which includes a cleaning unit configured to perform cleaning of a surface of an electrophotographic photoreceptor before charging after transfer of a toner image; an apparatus which includes an erasing unit configured to irradiate a surface of an electrophotographic photoreceptor with erasing light before charging after transfer of a toner image, so as to perform erasing; and an apparatus which includes an electrophotographic photoreceptor heating member configured to increase the temperature of an electrophotographic photoreceptor so as to reduce a relative temperature.

The image forming apparatus according to the exemplary embodiment may be either an image forming apparatus of dry developing type or an image forming apparatus of a wet developing type (a developing type using a developer liquid).

In the image forming apparatus according to the exemplary embodiment, for example, a portion including the electrophotographic photoreceptor may be a cartridge structure (process cartridge) which is detachable from the image forming apparatus. The process cartridge may include at least one selected from, for example, a group which is formed from a charging unit, an electrostatic latent image forming unit, a developing unit, and a transfer unit, in addition to the electrophotographic photoreceptor.

Hereinafter, the image forming apparatus according to the exemplary embodiment will be described in detail with reference to the drawings.

FIG. 1 is a schematic configuration diagram illustrating an example of an image forming apparatus according to the exemplary embodiment.

As illustrated in FIG. 1, an image forming apparatus 100 according to the exemplary embodiment includes a process cartridge 300 which includes an electrophotographic photoreceptor 7, an exposure device (an example of the electrostatic latent image forming unit) 9, a transfer device (primary transfer device) 40, and an intermediate transfer member 50. In the image forming apparatus 100, the exposure device 9 is disposed at a position in which the electrophotographic photoreceptor 7 may be exposed through the opening of the process cartridge 300, the transfer device 40 is disposed at a position facing the electrophotographic photoreceptor 7 through the intermediate transfer member 50, and the intermediate transfer member 50 is disposed so as to cause a portion thereof to contact with the electrophotographic photoreceptor 7. Although not illustrated, the image forming apparatus 100 further includes a secondary transfer device configured to transfer the toner image transferred to the intermediate transfer member 50, to a recording medium (for example, paper).

The transfer device 40 corresponds to an example of the primary transfer unit, and a secondary transfer device (not illustrated) corresponds to an example of the secondary transfer unit.

In FIG. 1, the process cartridge 300 integrally supports an electrophotographic photoreceptor 7, a charging device (an example of a charging unit) 8, a developing device (an example of a developing unit) 11, and a cleaning device (an example of a cleaning unit) 13 in a housing. The cleaning device 13 has a cleaning blade (an example of a cleaning member) 131. The cleaning blade 131 is disposed to contact with a surface of the electrophotographic photoreceptor 7. The cleaning member may be a conductive or insulating fibrous member instead of the form of the cleaning blade 131, and may be used alone or in combination with the cleaning blade 131.

FIG. 1 illustrates an example of an image forming apparatus which includes a fibrous member (roller-shaped) 132 and a fibrous member (flat brush-shaped) 133. The fibrous member 132 supplies a lubricating member 14 to the surface of the electrophotographic photoreceptor 7. The fibrous member 133 assists cleaning. However, these members are disposed as necessary.

A configuration of the image forming apparatus according to the exemplary embodiment will be described below.

Electrophotographic Photoreceptor

As the electrophotographic photoreceptor 7, a photoreceptor having a configuration of including an electroconductive substrate, an undercoat layer provided on the electroconductive substrate, and a photosensitive layer provided on the undercoat layer is applied.

The photosensitive layer may be a photosensitive layer of a function separation type which includes a charge generation layer and a charge transport layer (also referred to as "a function-separated type photosensitive layer" below), or be a photosensitive layer of a single layer type (also referred to as "a single-layer type photosensitive layer" below). In a case where the photosensitive layer is a function-separated type photosensitive layer, the charge generation layer contains a charge generating material, and the charge transport layer contains a charge transporting material.

The electrophotographic photoreceptor according to the exemplary embodiment will be described below in detail with reference to the drawings.

Figure 2:
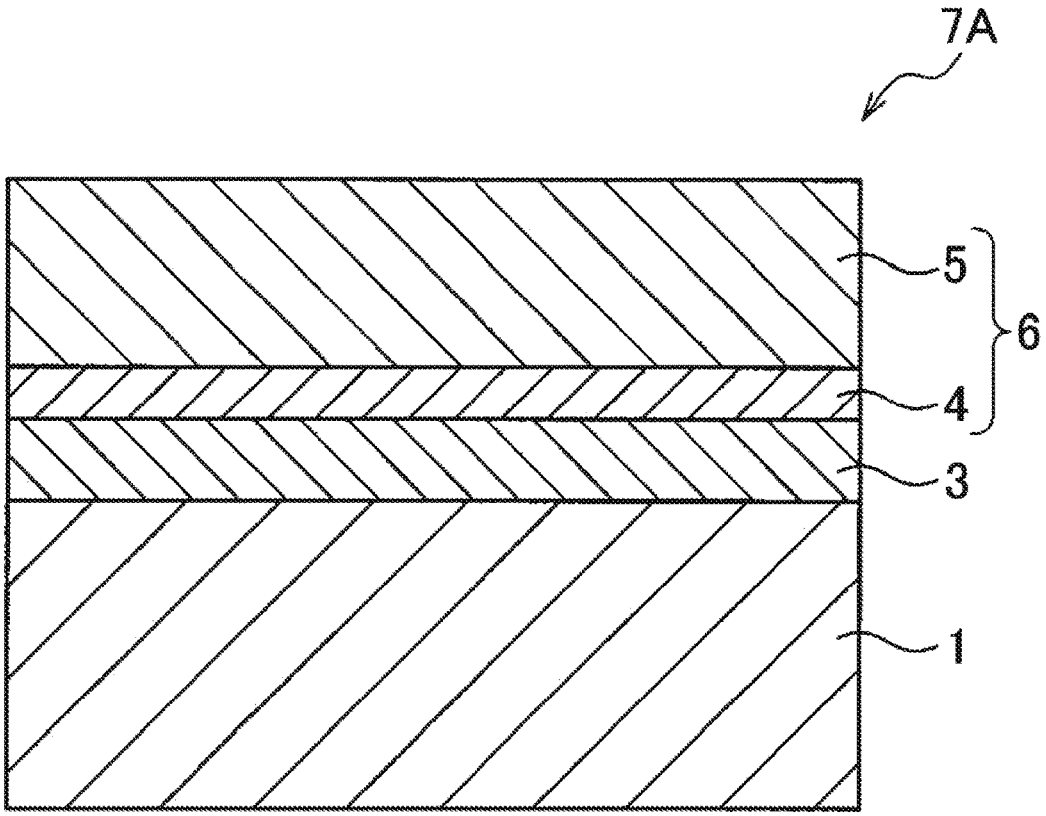
FIG. 2 is a schematic partially-sectional view illustrating an example of a layer configuration of an electrophotographic photoreceptor according to the exemplary embodiment.

FIG. 2 is a schematic sectional view illustrating an electrophotographic photoreceptor 7A as an example of a layer configuration of the electrophotographic photoreceptor 7. The electrophotographic photoreceptor 7A illustrated in FIG. 2 has a structure in which an undercoat layer 3, a charge generation layer 4, and a charge transport layer 5 are stacked on an electroconductive substrate 1 in this order. The charge generation layer 4 and the charge transport layer 5 constitute a function-separated type photosensitive layer 6.

The electrophotographic photoreceptor 7A may include other layers if necessary. Examples of the layer provided if necessary include a protective layer which is further provided on the charge transport layer 5.

Figure 3:
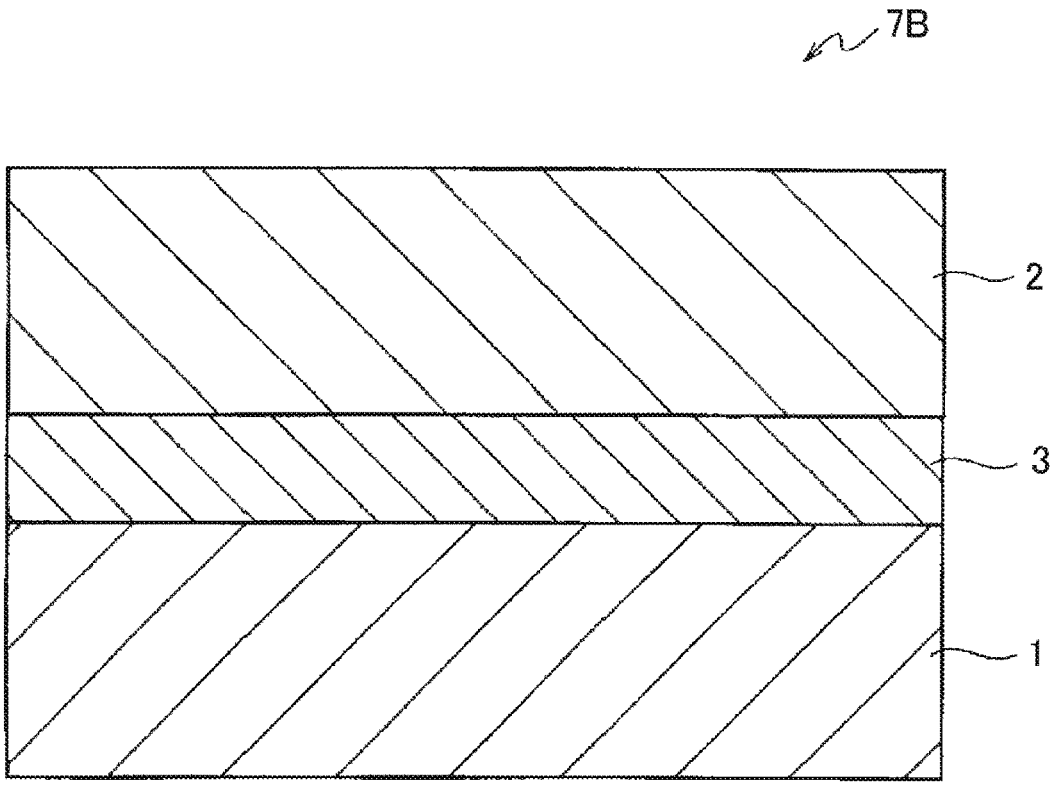
FIG. 3 is a schematic partially-sectional view illustrating another example of the layer configuration of the electrophotographic photoreceptor according to the exemplary embodiment.

FIG. 3 is a schematic sectional view illustrating an electrophotographic photoreceptor 7B as another example of the layer configuration of the electrophotographic photoreceptor 7. The electrophotographic photoreceptor 7B illustrated in FIG. 3 has a structure in which an undercoat layer 3 and a single-layer type photosensitive layer 2 are stacked on an electroconductive substrate 1 in this order.

The electrophotographic photoreceptor 7B may include other layers if necessary. Examples of the layer provided if necessary include a protective layer which is further provided on the single-layer type photosensitive layer 2.

Each of the layers of the electrophotographic photoreceptor 7 will be described below in detail. Descriptions will be made with the reference signs omitted.

Electroconductive Substrate

Examples of the electroconductive substrate include metal plates, metal drums, and metal belts containing metals (aluminum, copper, zinc, chromium, nickel, molybdenum, vanadium, indium, gold, platinum, and the like) or alloys (stainless steel and the like). Other examples of the electroconductive substrate include paper, resin films, and belts, each formed by applying, depositing, or laminating conductive compounds (for example, a conductive polymer and indium oxide), metals (for example, aluminum, palladium, and gold), or alloys. The term "being conductive" herein refers to having a volume resistivity of less than $10^{13}$ Ωcm.

In the case where the electrophotographic photoreceptor is used in a laser printer, the surface of the electroconductive substrate is preferably roughened at a center-line average roughness, Ra, which is from 0.04 Ωm to 0.5 Ωm in order to prevent an interference fringe generated upon radiation with laser light. In the case where an incoherent light source is used, there is no particular need for the surface of the electroconductive substrate to be roughened so as to prevent an interference fringe, and such an incoherent light source may prevent occurrence of defects due to uneven surface of the electroconductive substrate, and is therefore more suitable for prolonging the lifetime.

Examples of a surface roughening method include wet honing in which an abrasive suspended in water is sprayed to a support, centerless grinding in which continuous grinding is carried out by pressing the electroconductive substrate against a rotating grindstone, and an anodization treatment.

Other examples of the surface roughening method include a method in which while not roughening the surface of the electroconductive substrate, conductive or semiconductive powder is dispersed in a resin, the resin is applied onto the surface of the electroconductive substrate to form a layer, and roughening is carried out by the particles dispersed in the layer.

In the surface roughening treatment by anodization, an electroconductive substrate formed of a metal (for example, aluminum) serves as the anode in an electrolyte solution and is anodized to form an oxide film on the surface of the electroconductive substrate. Examples of the electrolyte solution include a sulfuric acid solution and an oxalic acid solution. A porous anodized film formed by anodizing is, however, chemically active in its natural state, and thus, such an anodized film is easily contaminated, and its resistance greatly varies depending on environment. Accordingly, a treatment for closing the pores of the porous anodized film is preferably carried out; in such a process, the pores of the oxidized film are closed by volume expansion due to a hydration reaction in steam under pressure or in boiled water (a metal salt such as nickel may be added), and the porous anodized film is converted into more stable hydrous oxide.

The film thickness of the anodized film is preferably, for example, from 0.3 μm to 15 μm. If the film thickness is in this range, a barrier property for implantation tends to be exerted and an increase in residual potential due to repeated uses tends to be prevented.

The electroconductive substrate may be subjected to a treatment with an acidic treatment solution or a boehmite treatment.

The treatment with an acidic treatment solution is carried out, for example, as follows. Firstly, an acidic treatment solution containing phosphoric acid, chromic acid, and hydrofluoric acid is prepared. For the blend ratio of the phosphoric acid, the chromic acid, and the hydrofluoric acid in the acidic treatment solution, for example, the amount of the phosphoric acid is in the range from 10% by weight to 11% by weight, the amount of the chromic acid is in the range from 3% by weight to 5% by weight, and the amount of the hydrofluoric acid is in the range from 0.5% by weight to 2% by weight, and the total concentration of these acids is preferably in the range from 13.5% by weight to 18% by weight. The temperature for the treatment is preferably, for example, from 42° C. to 48° C. The film thickness of the coating film is preferably from 0.3 μm to 15 μm.

In the boehmite treatment, for example, the electroconductive substrate is immersed into pure water at a temperature from 90° C. to 100° C. from 5 minutes to 60 minutes or brought into contact with heated water vapor at a temperature from 90° C. to 120° C. from 5 minutes to 60 minutes. The film thickness of the coating film is preferably from 0.1 μm to 5 μm. The obtained product may be subjected to an anodization treatment with an electrolyte solution which less dissolves the coating film, such as adipic acid, boric acid, borate, phosphate, phthalate, maleate, benzoate, tartrate, and citrate.

Undercoat Layer

The undercoat layer is provided between the electroconductive substrate and the photosensitive layer, and has electrostatic capacitance per unit area which is from $2.5\times10^{-11}$ F/cm$^2$ to $2.5\times10^{-10}$ F/cm$^2$.

As described above, the electrostatic capacitance per unit area of the undercoat layer is in the above range, and thus the occurrence of ghost is prevented in comparison to a case of being more than the above range. The electrostatic capacitance per unit area of the undercoat layer is in the above range, and thus good electrical characteristics of the photoreceptor are obtained easier than in a case of being less than the above range.

The electrostatic capacitance per unit area of the undercoat layer is preferably from $2.5\times10^{-11}$ F/cm$^2$ to $1.5\times10^{-10}$ F/cm$^2$, and more preferably from $5.0\times10^{-11}$ F/cm$^2$ to $1.5\times10^{-10}$ F/cm$^2$, from a viewpoint of preventing the occurrence of ghost.

Here, a method of obtaining the electrostatic capacitance per unit area of the undercoat layer will be described.

For example, as an equivalent circuit of a conductive organic film constituting each of the layers in the electrophotographic photoreceptor, generally, a parallel circuit of a resistor (resistance value: R) and a capacitor (electrostatic capacitance: C) is applied. As a method of analyzing and calculating a resistance value R and an electrostatic capacitance C in a parallel circuit in which the resistance value R and the electrostatic capacitance C are unknown, Cole·Cole Plot analysis is exemplified.

The Cole·Cole Plot analysis refers to a method in which electrodes are attached to both ends of a parallel circuit (for example, conductive organic film) in which a resistance value R and an electrostatic capacitance C are unknown, an AC voltage is applied to the both of the electrodes while changing a frequency, and a positional relationship between the applied voltage and the obtained current is analyzed. The resistance value R and the electrostatic capacitance C in the parallel circuit are obtained by using this method, and the electrostatic capacitance per unit area is obtained based on the obtained value of the electrostatic capacitance C and a value of an area of the attached electrode.

Specifically, for example, firstly, gold electrodes of φ6 mm as facing electrodes are formed on the outer circumferential surface of the undercoat layer by a vapor deposition method, and then measuring is performed at a normal temperature and normal humidity (22° C./50%RH) by the 126096 W impedance analyzer (manufactured by Solartron Corp.).

As measuring conditions, for example, a DC vias (applied DC voltage) of 0 V, an AC (applied AC voltage) of±1 V, and a frequency in a range of from 1 Hz to 100 Hz are exemplified.

The electrostatic capacitance C is obtained based on the obtained measurement results, by the Cole·Cole Plot analysis, and is divided by an electrode area S (cm$^2$) of the facing electrode. Thus, the electrostatic capacitance per unit area of the undercoat layer is calculated.

As a method of measuring the electrostatic capacitance per unit area from a photoreceptor functioning as a measurement target, for example, the following method is exemplified.

Firstly, a photoreceptor functioning as a measurement target is prepared. Next, for example, a photosensitive layer such as a charge generation layer and a charge transport layer, which cover an undercoat layer is removed by using a solvent such as acetone, tetrahydrofuran, methanol, ethanol, and thus the undercoat layer is exposed. A gold electrode is formed on the exposed undercoat layer by a unit using a vapor deposition method, a sputtering method, or the like, thereby a measurement sample is obtained. Measurement is performed on this measurement sample, and thus the electrostatic capacitance per unit area is obtained.

A method of controlling the electrostatic capacitance per unit area of the undercoat layer is not particularly limited. In a case where the undercoat layer is a layer containing a binder resin, a metal oxide particle, and an electron accepting compound, for example, the following methods are exemplified: a method of adjusting dispersity of metal oxide particles in the undercoat layer; a method of adjusting a particle diameter of the metal oxide particle; a method of adjusting a surface-treating amount of metal oxide particles (that is, an amount of a surface treating agent used in surface treatment of metal oxide particles); a method of adjusting the content of metal oxide particles (content when the surface treating agent is also contained in a case where the surface treating agent adheres to the surfaces of the metal oxide particles); a method of changing a combination of the type of the surface treating agent for the metal oxide particle and the type of the binder resin; a method of adjusting the content of the electron accepting compound; and a method obtained by combining the above-described methods.

Specifically, an appropriate adjusting method varies depending on a condition such as types of various materials, a combination, and the content. For example, if the dispersity of the metal oxide particles is decreased, the electrostatic capacitance of the undercoat layer tends to be decreased. If the dispersity of the metal oxide particles is increased, the electrostatic capacitance of the undercoat layer tends to be increased.

In a case where a coating film of a coating liquid for forming an undercoat layer, in which the metal oxide particles are dispersed, is formed so as to form the undercoat layer, secondary particles obtained by aggregating primary particles may exist along with the primary particles of the metal oxide particles in the film of the formed undercoat layer. The metal oxide particles of the secondary particles have a particle diameter more than that of the primary particles, and existence of these secondary particles cause a path on which charges move to be easily formed. Thus, for example, the dispersity of the metal oxide particles is adjusted to control the metal oxide particles of the secondary particles. Accordingly, the electrostatic capacitance per unit area of the undercoat layer is controlled.

Specifically, in a case where the dispersity of the metal oxide particles is low (that is, in a case where a dispersion particle diameter of the metal oxide particles is large), mobility of charges in the undercoat layer is increased, and the electrostatic capacitance per unit area is easily decreased. In a case where the dispersity of the metal oxide particles is high (that is, in a case where the dispersion particle diameter of the metal oxide particles is small), the mobility of charges in the undercoat layer is decreased, and the electrostatic capacitance per unit area tends to be easily increased.

As the method of adjusting the dispersity, for example, a method of performing adjustment in accordance with a dispersing time and the like of the metal oxide particles when the coating liquid for forming an undercoat layer is formed is exemplified.

For example, if the particle diameter of the metal oxide particles is set to be large, the electrostatic capacitance of the undercoat layer is decreased. If the particle diameter of the metal oxide particles is set to be small, the electrostatic capacitance of the undercoat layer tends to be increased.

Further, in a case where a zinc oxide particle which has an amino group and is subjected to surface treatment by the silane coupling agent is used as the metal oxide particle, and an acetal resin is used as the binder resin, for example, if the surface-treating amount of metal oxide particles is large, the dispersity of the metal oxide particles is decreased, and thus the electrostatic capacitance of the undercoat layer is decreased. If the surface-treating amount of the metal oxide particles is small, the dispersity of the metal oxide particles is increased, and thus the electrostatic capacitance of the undercoat layer tends to be increased.

For example, if the content of the metal oxide particles is large, an amount of the binder resin is decreased, and thus the electrostatic capacitance of the undercoat layer is decreased. If the content of the metal oxide particles is small, the amount of the binder resin is increased, and thus the electrostatic capacitance of the undercoat layer tends to be increased.

For example, if the content of the electron accepting compound is large, the electrostatic capacitance of the undercoat layer is decreased. If the content of the electron accepting compound is small, the electrostatic capacitance of the undercoat layer tends to be increased.

Regarding a layer which contains the binder resin, the metal oxide particles, and the electron accepting compound, as an example of the undercoat layer, a material, a preparing method, characteristics, and the like will be described below.

Metal Oxide Particle

Examples of the metal oxide particle include a tin oxide particle, a titanium oxide particle, a zinc oxide particle, and a zirconium oxide particle. Among these particles, at least one type selected from the tin oxide particle, the titanium oxide particle, and the zinc oxide particle is preferable, and the zinc oxide particle is more preferable. As the volume average primary particle diameter of metal oxide particles, for example, a range of from 10 nm to 100 nm is exemplified.

The volume average primary particle diameter of the metal oxide particles is in the above range, and thus uneven distribution in a dispersion occurring by an excessively-large surface area of the metal oxide particles is prevented in comparison to a case of being less than the above range. The volume average primary particle diameter of the metal oxide particles is in the above range, and thus uneven distribution in the undercoat layer occurring by an excessively-large particle diameter of secondary particles or particles of a high order which is equal to or more than the second is prevented in a case of being more than the above range. If the uneven distribution occurs in the undercoat layer, a sea-island structure in which a portion at which the metal oxide particles exist, and a portion at which the metal oxide particles do not exist are provided is formed in the undercoat layer, and thus an image defect such as unevenness of half-tone density may occur.

The volume average primary particle diameter of the metal oxide particles is preferably from 40 nm to 100 nm, and more preferably from 40 nm to 80 nm, from a viewpoint of adjusting the electrostatic capacitance per unit area of the undercoat layer to be in the above range.

The volume average primary particle diameter of the metal oxide particles is measured by using a laser-diffraction type particle diameter distribution measuring device (LA-700: HORIBA, Ltd.). Regarding a measuring method, a sample in a state of being a dispersion is adjusted by using a solid powder, so as to be 2 g. Ion exchange water is added to the adjusted sample to thereby prepare 40 ml. The resultant is inserted into a cell so as to have an appropriate concentration, and waits for 2 minutes. Then, measurement is performed. Among particle diameters of obtained channels, accumulation is performed from a small particle diameter with a volume as a standard. A value when the accumulated value reaches 50% is defined as the volume average primary particle diameter.

As volume resistivity of the metal oxide particles, for example, a range of from $10^4$ Ω·cm to $10^{11}$ Ω·cm is exemplified.

It is preferable that the undercoat layer obtains appropriate impedance at a frequency corresponding to an electrophotographic process speed. From this viewpoint, the volume resistivity of the metal oxide particles is preferably in the above range. That is, the volume resistivity of the metal oxide particles is in the above range, and thus an inclination of particle content dependency of the impedance becomes smaller, and control difficulty of the impedance is easily prevented, in comparison to a case of being lower than the above range. The volume resistivity of the metal oxide particles is in the above range, and thus an increase of the residual potential is prevented easier than in a case of being higher than the above range.

From a viewpoint of adjusting the electrostatic capacitance per unit area of the undercoat layer to be in the above range, the volume resistivity of metal oxide particles is preferably from $10^6$ Ω·cm to $10^{11}$ Ω·cm, and more preferably from $10^8$ Ω·cm to $10^{11}$ Ω·cm.

The volume resistivity of metal oxide particles is measured in the following manner. A measurement environment is defined as a temperature of 20° C., and humidity of 50% RH.

Firstly, metal oxide particles are separated from the layer. The separated metal oxide particles to be measured are placed on a surface of a circular tool on which an electrode plate of 20 $cm^2$ is disposed, so as to have a thickness of about from 1 mm to 3 mm. Thus, a metal oxide particle layer is formed. The similar electrode plate of 20 $cm^2$ is placed on the formed metal oxide particle layer, and thus the metal oxide particle layer is interposed between the electrode plates. In order to cause void between the metal oxide particles not to be provided, a load of 4 kg is applied onto the electrode plate placed on the metal oxide particle layer, and then the thickness (cm) of the metal oxide particle layer is measured. Both of the electrodes on and under the metal oxide particle layer are connected to an electrometer and a high-voltage power generation device. A high voltage is applied to both of the electrodes, so as to cause an electric field to have a predetermined value. A value (A) of a current flowing at this time is read, and thus the volume resistivity (Ω·cm) of the metal oxide particles is calculated. A calculation expression of the volume resistivity (Ω·cm) of the metal oxide particles is as follows.

In the expression, p represents the volume resistivity (Ω·cm) of the metal oxide particles, E represents an applied voltage (V), and I represents a current value (A). $I_0$ represents the current value (A) at the applied voltage of 0 V, and L represents a thickness (cm) of the metal oxide particle layer. In this evaluation, volume resistivity is used when the applied voltage is 1,000 V.

$$\rho = E \times 20/(I - I_0)/L \qquad \text{Expression:}$$

As a BET specific surface area of the metal oxide particles, for example, a range of 10 $m^2/g$ or more is exemplified. From a viewpoint of adjusting the electrostatic capacitance per unit area of the undercoat layer to be in the above range, the BET specific surface area is preferably from 10 $m^2/g$ to 22 $m^2/g$, and more preferably from $^{10}$ $m^2/g$ to 17 $m^2/g$.

The BET specific surface area has a value measured by a nitrogen substitution method using a BET specific surface area measuring instrument (FLOWSORP II 2300 manufactured by Shimadzu Seisaku-sho Ltd.).

As the content of the metal oxide particles, for example, a range of from 30% by weight to 80% by weight with respect to the total solid content of the undercoat layer is exemplified. From a viewpoint of maintaining electrical characteristics, the content of the metal oxide particles is preferably from 35% by weight to 75% by weight. From a viewpoint of adjusting the electrostatic capacitance per unit area of the undercoat layer to be in the above range, the content of the metal oxide particles is preferably from 35% by weight to 80% by weight, and more preferably from 35% by weight to 75% by weight, with respect to the total solid content of the undercoat layer.

The metal oxide particles may be subjected to surface treatment by using a surface treating agent, and is preferably subjected to surface treatment by using one or more types of coupling agents among surface treating agents. The coupling agent generally has an action of chemically bonding an organic material and an inorganic material. For example, a compound containing a functional group which has affinity or reactivity with the surfaces of the metal oxide particles is exemplified.

As the metal oxide particle, a mixture of two or more types of metal oxide particles which are subjected to different surface treatments may be used, or a mixture of two or more types of metal oxide particles which have different particle diameters may be used.

Examples of the surface treating agent include a silane coupling agent, a titanate coupling agent, an aluminum coupling agent, and a surfactant. Particularly, a silane coupling agent is preferable, and a silane coupling agent having an amino group is more preferable.

Examples of the silane coupling agent having an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more types of silane coupling agents may be used as a mixture. For example, the silane coupling agent having an amino group may be used in combination with another silane coupling agent. Examples of such another silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method by using a surface treating agent may be any known method, and may be either a dry type method or a wet type method.

The metal oxide particles are subjected to surface treatment by, for example, using the coupling agent, and then, if necessary, may be subjected to thermal treatment for the purpose of, for example, improving environment dependency of the volume resistivity of the metal oxide particles. As a temperature in the thermal treatment, for example, a range of 150° C. to 300° C. is exemplified. As a treating time in the thermal treatment, for example, a range of 30 minutes to 5 hours is exemplified.

As the treating amount of the surface treating agent, for example, a range of 0.5% by weight to 10% by weight with respect to the metal oxide particles is exemplified. For example, in a case where a zinc oxide particle subjected to surface treatment by using a silane coupling agent which contains an amino group is used as the metal oxide particle, and the acetal resin is used as the binder resin, the treating amount of the surface treating agent on metal oxide particles is preferably from 0.5% by weight to 5.0% by weight, and more preferably from 0.5% by weight to 2.0% by weight, from a viewpoint of adjusting the electrostatic capacitance per unit area of the undercoat layer to be in the above range.

Electron Accepting Compound

The electron accepting compound may be contained in the undercoat layer after having been dispersed together with the metal oxide particles therein, or may be contained in a state of having adhered to the surfaces of the metal oxide particles. In a case where the electron accepting compound is contained in the state of having adhered to the surfaces of the metal oxide particles, the electron accepting compound is preferably a material which conducts a chemical reaction with the surfaces of the metal oxide particles, or a material which adheres to the surfaces of the metal oxide particles. The electron accepting compound may be selectively provided on the surfaces of the metal oxide particles.

An example of the electron accepting compound includes an electron accepting compound which has a quinone skeleton, an anthraquinone skeleton, a coumarin skeleton, a phthalocyanine skeleton, a triphenylmethane skeleton, an anthocyanin skeleton, a flavone skeleton, a fullerene skeleton, a ruthenium complex skeleton, a xanthene skeleton, a benzoxazine skeleton, and a porphyrin skeleton.

The electron accepting compound may be a compound in which substitution with a substituent such as an acidic group (for example, a hydroxyl group, a carboxyl group, and a sulfonyl group), an aryl group, and an amino group is performed in the skeletons.

Particularly, from a viewpoint of adjusting the electrostatic capacitance per unit area of the undercoat layer to be the above range, as the electron accepting compound, an electron accepting compound having an anthraquinone skeleton is preferable. An electron accepting compound having a hydroxy anthraquinone skeleton (anthraquinone skeleton having a hydroxyl group) is more preferable.

A specific example of the electron accepting compound having a hydroxy anthraquinone skeleton includes a compound represented by the following formula (1).

Formula (1)

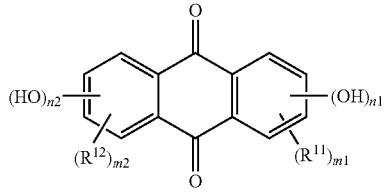

In the formula (1), n1 and n2 each independently represent an integer of from 0 to 3. At least one of n1 and n2 represents an integer of from 1 to 3 (that is, n1 and n2 do not simultaneously represent 0). m1 and m2 each independently represent an integer of from 0 or 1. $R^{11}$ and $R^{12}$ each independently represent an alkyl group having from 1 to 10 carbon atoms, or an alkoxy group having from 1 to 10 carbon atoms.

The electron accepting compound may be a compound represented by the following formula (2).

Formula (2)

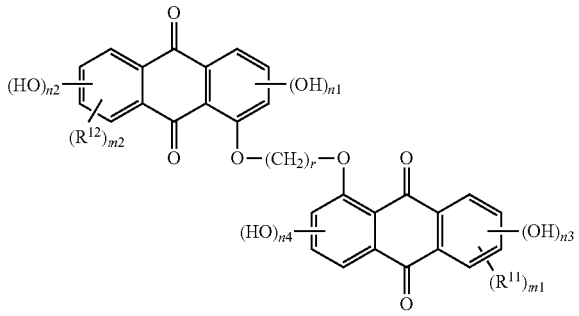

In the formula (2), n1, n2, n3 and n4 each independently represent an integer of from 0 to 3. m1 and m2 each independently represent an integer of from 0 or 1. At least one of n1 and n2 each independently represents an integer of from 1 to 3 (that is, n1 and n2 do not simultaneously represent 0). At least one of n3 and n4 each independently represents an integer of from 1 to 3 (that is, n3 and n4 do not simultaneously represent 0). r represents an integer of from 2 to 10. $R^{11}$ and $R^{12}$ each independently represent an alkyl group having from 1 to 10 carbon atoms, or an alkoxy group having from 1 to 10 carbon atoms.

Here, in the formulae (1) and (2), an alkyl group which is represented by $R^{11}$ and $R^{12}$ and has from 1 to 10 carbon atoms may be either of a linear or a branched alkyl group. For example, a methyl group, an ethyl group, a propyl group, and an isopropyl group are exemplified. As the alkyl group having from 1 to 10 carbon atoms, an alkyl group having from 1 to 8 carbon atoms is preferable, and an alkyl group having from 1 to 6 carbon atoms is more preferable.

An alkoxy group (alkoxyl group) which is represented by $R^{11}$ and $R^{12}$ and has from 1 to 10 carbon atoms may be either of a linear or a branched alkoxy group. For example, a methoxy group, an ethoxy group, a propoxy group, and an isopropoxy group are exemplified. As the alkoxy group having from 1 to 10 carbon atoms, an alkoxyl group having from 1 to 8 carbon atoms is preferable, and an alkoxyl group having from 1 to 6 carbon atoms is more preferable.

A specific example of the electron accepting compound will be described below, but is not limited thereto.

1-1

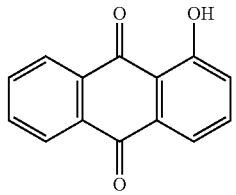

-continued
1-2
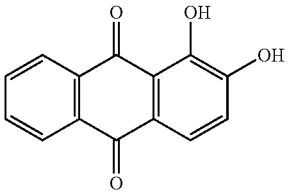
1-3
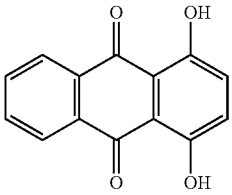
1-4
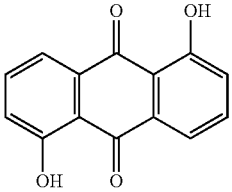
1-5
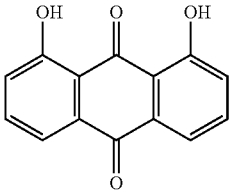
1-6
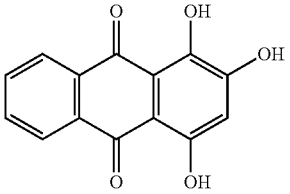
1-7
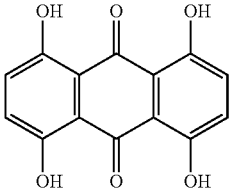
1-8
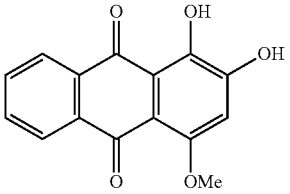
1-9
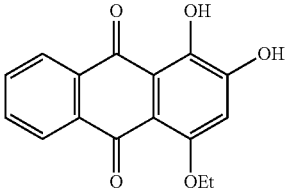
-continued
1-10
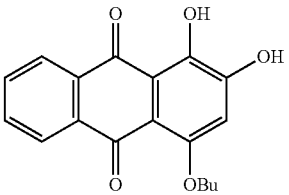
1-11
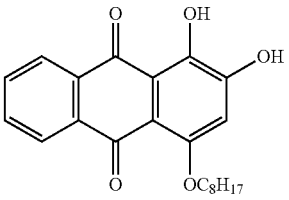
1-12
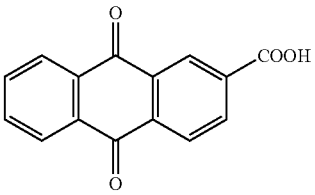
1-13
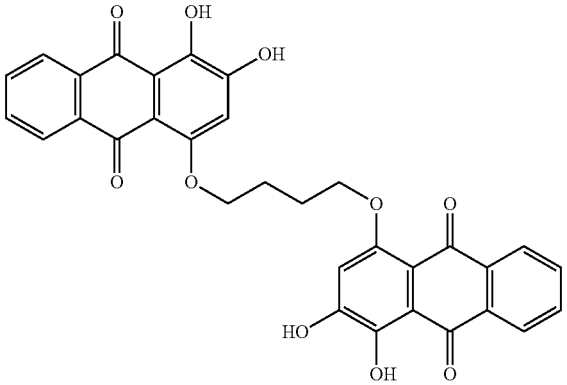
1-14
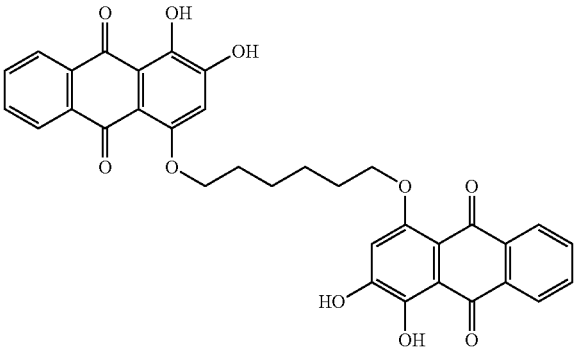
1-15
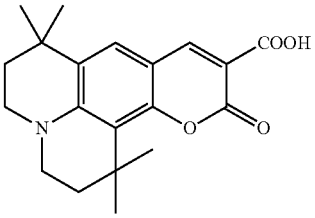

-continued 1-16

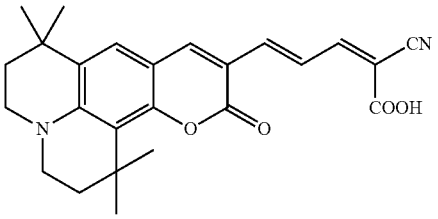

1-17

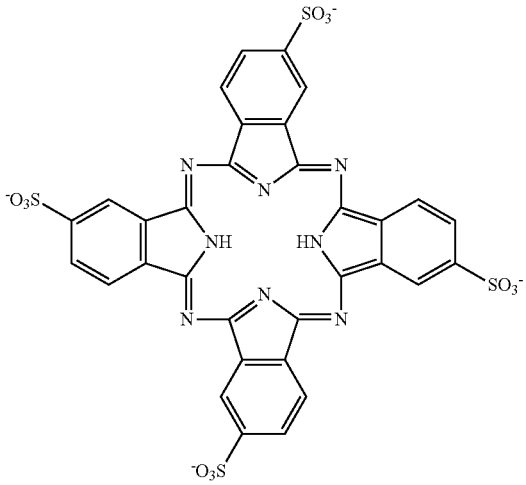

1-18

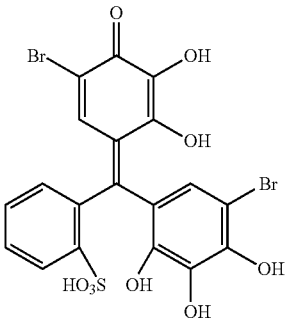

1-19

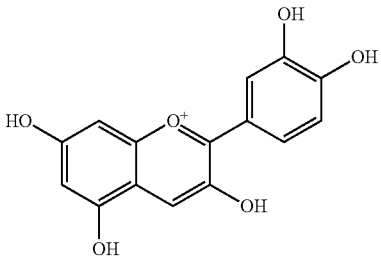

1-20

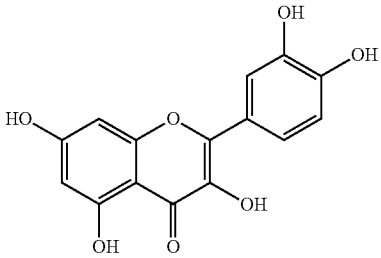

-continued 1-21

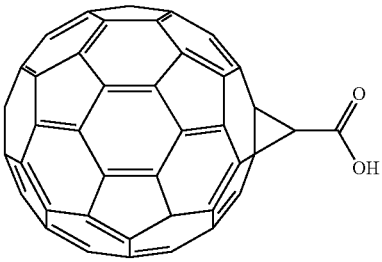

1-22

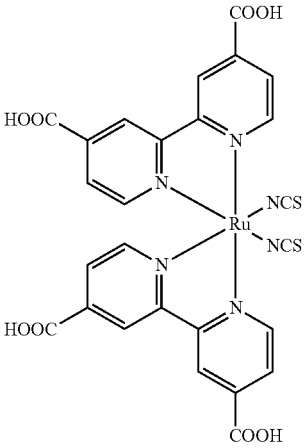

Examples of a method of allowing the electron accepting compound to adhere to the surfaces of the metal oxide particles include a dry type method and a wet type method.

The dry type method is, for example, a method in which an electron accepting compound is allowed to adhere to the surfaces of the metal oxide particles as follows: metal oxide particles are stirred in a mixer with a high shear force, and in this state, the electron accepting compound as it is or as a solution in which the electron accepting compound dissolved in an organic solvent is dropped or sprayed along with dried air or a nitrogen gas. The electron accepting compound may be dropped or sprayed at a temperature that is equal to or lower than the boiling point of the solvent. After dropping or spraying the electron accepting compound, baking may be carried out at equal to or higher than 100° C. Baking may be carried out at any temperature for any length of time provided that electrophotographic properties are obtained.

The wet type method is, for example, a method in which the electron accepting compound is allowed to adhere to the surfaces of the metal oxide particles as follows: the metal oxide particles are dispersed in a solvent by a technique involving stirring, ultrasonic wave, a sand mill, an attritor, or a ball mill, in this state, the electron accepting compound is added thereto and then stirred or dispersed, and the solvent is subsequently removed. The solvent is removed through, for example, being filtered or distilled off by distillation. After the removal of the solvent, baking may be carried out at equal to or higher than 100° C. Baking may be carried out at any temperature for any length of time provided that electrophotographic properties are obtained. In the wet type method, the contained moisture in the metal oxide particles may be removed in advance of the addition of the electron accepting compound, and examples of the wet type method include a method in which the contained moisture is removed by stirring in a solvent under heating or a method in which the contained moisture is removed by azeotropy with a solvent.

The electron accepting compound may be allowed to adhere before or after metal oxide particles are subjected to surface treatment by using the surface treating agent. In addition, the adhesion of the electron accepting compound and the surface treatment with the surface treating agent may be simultaneously carried out.

As the content of the electron accepting compound, for example, a range of 0.01% by weight to 20% by weight with respect to the total solid content of the undercoat layer is exemplified. The content of the electron accepting compound is preferably from 0.1% by weight to 10% by weight, and more preferably from 0.5% by weight to 5% by weight.

The content of the electron accepting compound is in the above range, and thus an effect of the electron accepting compound as an acceptor is obtained easier than in a case of being less than the above range. The content of the electron accepting compound is in the above range, and thus it is difficult to aggregate metal oxide particles and to cause uneven distribution of the metal oxide particles to excessively occur in the undercoat layer in comparison to a case of being more than the above range. In addition, it is difficult to cause an increase of the residual potential, occurrence of a black spot, and occurrence of unevenness of half-tone density due to excessive uneven distribution of the metal oxide particles.

From a viewpoint of adjusting the electrostatic capacitance per unit area of the undercoat layer to be in the above range, the content of the electron accepting compound is preferably from 0.5% by weight to 2.0% by weight, and more preferably from 0.5% by weight to 1.0% by weight, with respect to the total solid content of the undercoat layer.

Binder Resin

Examples of the binder resin used in the undercoat layer include known high molecular compounds such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and known materials such as silane coupling agents.

Other examples of the binder resin for use in the undercoat layer include charge transporting resins having charge transporting groups and conductive resins (for example, polyaniline).

Among these materials, a resin that is insoluble in a solvent used in coating for forming the upper layer is suitable as the binder resin used in the undercoat layer. In particular, resins obtained by a reaction of a curing agent with at least one resin selected from the group consisting of thermosetting resins such as urea resins, phenolic resins, phenol-formaldehyde resins, melamine resins, urethane resins, unsaturated polyester resins, alkyd resins, and epoxy resins; polyamide resins; polyester resins; polyether resins; methacrylic resins; acrylic resins; polyvinyl alcohol resins; and polyvinyl acetal resins are suitable.

In the case where two or more kinds of these binder resins are used in combination, the mixing ratio thereof is determined, as necessary.

Additive

The undercoat layer may contain various additives in order to improve electrical properties, environmental stability, and image quality.

Examples of the additives include an electron transporting pigment such as a condensed polycyclic pigment and an azo pigment, and known materials such as zirconium chelate compounds, titanium chelate compounds, aluminum chelate compounds, titanium alkoxide compounds, organic titanium compounds, and silane coupling agents. The silane coupling agent is used for the surface treatment of the metal oxide particles as described above, but may be further added to the undercoat layer, as an additive.

Examples of the silane coupling agent as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compound include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compound include tetraisopropyl titanate, tetra-normal-butyl titanate, butyl titanate dimers, tetra(2-ethylhexyl)titanate, titanium acetylacetonate, polytitanium acetylacetonate, titanium octylene glycolate, titanium lactate ammonium salts, titanium lactate, titanium lactate ethyl esters, titanium triethanol aminate, and polyhydroxytitanium stearate.

Examples of the aluminum chelate compound include aluminum isopropylate, monobutoxyaluminum diisopropylate, aluminum butylate, diethyl acetoacetate aluminum diisopropylate, and aluminum tris(ethyl acetoacetate).

These additives may be used singly or as a mixture or a polycondensate of plural kinds thereof.

The undercoat layer may have Vickers hardness of 35 or more.

In order to prevent a moire fringe, surface roughness (ten-point average roughness) of the undercoat layer may be adjusted to a range from 1/(4 n) (n is the refractive index of the upper layer) to ½ of the wavelength λ of the exposure laser to be used.

In order to adjust the surface roughness, resin particles or the like may be added to the undercoat layer. Examples of the resin particles include silicone resin particles and cross-linked polymethyl methacrylate resin particles. In addition, the surface of the undercoat layer may be polished to adjust the surface roughness. Examples of a polishing method include buffing polishing, sand blasting treatment, wet honing, and grinding treatment.

Method of Forming Undercoat Layer

A technique for forming the undercoat layer is not particularly limited, and any known technique is used. For example, a coating film of a coating liquid for forming an undercoat layer, which is obtained by adding the above components to a solvent is formed. Then, the formed coating film is dried, and, as necessary, is heated.

Examples of the solvent used in the preparation of the coating liquid for forming an undercoat layer include known organic solvents such as an alcohol solvent, an aromatic hydrocarbon solvent, a halogenated hydrocarbon solvent, a ketone solvent, a ketone alcohol solvent, an ether solvent, and an ester solvent.

Specific examples of these solvents include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a method for dispersing the metal oxide particles when the coating liquid for forming an undercoat layer is prepared include known methods using a roller mill, a ball mill, a vibratory ball mill, an attritor, a sand mill, a colloid mill, a paint shaker, or the like.

Examples of a method for applying the coating liquid for forming an undercoat layer onto the electroconductive substrate include common methods such as a blade coating method, a wire-bar coating method, a spray coating method, a dipping coating method, a bead coating method, an air knife coating method, and a curtain coating method.

The film thickness of the undercoat layer is, for example, set to be in a range of preferably equal to or more than 15 μm, more preferably from 15 μm to 50 μm, and further preferably from 15 μm to 35 μm.

Intermediate Layer

Although not illustrated, an intermediate layer may further be provided between the undercoat layer and the photosensitive layer.

The intermediate layer is a layer which contains a resin, for example. Examples of the resin used in the intermediate layer include polymeric compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer which contains an organic metal compound. Examples of the organic metal compound used in the intermediate layer include those that contain metal atoms such as zirconium, titanium, aluminum, manganese, and silicon.

These compounds used in the intermediate layer may be used singly or as a mixture or a polycondensate of plural kinds of the compounds.

Among these materials, the intermediate layer is preferably a layer which contains an organic metal compound containing a zirconium atom or a silicon atom.

A technique for forming the intermediate layer is not particularly limited, and known methods are used. For example, a coating film for a coating liquid for forming an intermediate layer, which is obtained by adding the above components to a solvent is formed. Then, the formed coating film is dried, and, if necessary, is heated.

As a coating method used for forming the intermediate layer, common methods such as a dipping coating method, an extrusion coating method, a wire bar coating method, a spray coating method, a blade coating method, a knife coating method, and a curtain coating method are used.

The film thickness of the intermediate layer is preferably set to in a range of from 0.1 μm to 3 μm, for example. The intermediate layer may be used as the undercoat layer.

Charge Generation layer

The charge generation layer is a layer including, for example, a charge generating material and a binder resin. Further, the charge generation layer may be a vapor-deposited layer of a charge generating material. The vapor-deposited layer of a charge generating material is suitable in the case where an incoherent light source such as a Light Emitting Diode (LED) or an Organic Electro-Luminescence (EL) image array is used.

Examples of the charge generating material include azo pigments such as bisazo and trisazo pigments, fused aromatic pigments such as dibromoanthanthrone; perylene pigments; pyrrolopyrrole pigments; phthalocyanine pigments; zinc oxide; and trigonal selenium.

Among these, a metal phthalocyanine pigment or a metal-free phthalocyanine pigment is preferably used as a charge generating material in order to be compatible with laser exposure in a near-infrared region. Specifically, for example, hydroxygallium phthalocyanine, chlorogallium phthalocyanine, dichlorotin phthalocyanine, and titanyl phthalocyanine are more preferable.

On the other hand, in order to be compatible with laser exposure in a near-ultraviolet region, fused aromatic pigments such as dibromoanthanthrone; thioindigo pigments; porphyrazine compounds; zinc oxide; trigonal selenium, bisazo pigments are preferable as a charge generating material.

The charge generating materials may be used even in the case where an incoherent light source such as an organic EL image array or an LED having a center wavelength for light emission within the range from 450 nm to 780 nm is used. However, when the photosensitive layer is designed as a thin film having a thickness of 20 μm or less from the viewpoint of resolution, the electric field strength in the photosensitive layer increases and electrification obtained from charge injection from the electroconductive substrate decreases, thereby readily generating image defects referred to a so-called black spot. This phenomenon becomes notable when a charge generating material, such as trigonal selenium or a phthalocyanine pigment, that readily generates dark current in a p-type semiconductor is used.

In contrast, when a n-type semiconductor such as a fused aromatic pigment, a perylene pigment, and an azo pigment is used as the charge generating material, dark current rarely occurs and image defects referred to black spot are prevented even in the case where the photoconductive layer is in the form of a thin film.

Furthermore, whether the material is of a n-type is determined by the polarity of the photocurrent that flows in a commonly used time-of-flight method and the material in which electrons rather than holes easily flow as a carrier is identified as the n-type.

The binder resin used in the charge generation layer may be selected from a wide variety of insulating resins. Further, the binder resin may be selected from organic photoconductive polymers such as poly-N-vinylcarbazole, polyvinylanthracene, polyvinylpyrene, and polysilane.

Examples of the binder resin in the charge generation layer include polyvinyl butyral resins, polyarylate resins (a polycondensate of a bisphenol and a divalent aromatic dicarboxylic acid, and the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. The term "being insulating" herein refers to having a volume resistivity of equal to or more than $10^{13}$ Ωcm.

The binder resin may be used alone or as a mixture of two or more kinds thereof.

Moreover, the blend ratio of the charge generating material to the binder resin is preferably in the range from 10:1 to 1:10 in terms of weight ratio.

The charge generation layer may include other known additives.

A technique for forming the charge generation layer is not particularly limited, and known forming methods are used. For example, formation of the charge generation layer is carried out by forming a coating film of a coating liquid for forming a charge generation layer in which the components are added to a solvent, and drying the coating film, followed by heating, as desired. Further, formation of the charge generation layer may be carried out by vapor deposition of the charge generating materials. Formation of the charge generation layer by vapor deposition is particularly suitable in the case where a fused aromatic pigment or a perylene pigment is used as the charge generating material.

Examples of the solvent for preparing the coating liquid for forming a charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or as a mixture of two or more kinds thereof.

For a method for dispersing particles (for example, charge generating materials) in the coating liquid for forming a charge generation layer, media dispersers such as a ball mill, a vibratory ball mill, an attritor, a sand mill, and a horizontal sand mill or a medialess disperser such as a stirrer, an ultrasonic disperser, a roller mill, and a high-pressure homogenizer are used. Examples of the high-pressure homogenizer include a collision-type homogenizer in which dispersing is performed by subjecting the dispersion to liquid-liquid collision or liquid-wall collision in a high-pressure state and a penetration-type homogenizer in which dispersing is performed by causing the dispersion to penetrate fine channels in a high pressure state.

Incidentally, during the dispersion, it is effective to adjust the average particle diameter of the charge generating material in the coating liquid for forming a charge generation layer to 0.5 μm or less, preferably 0.3 μm or less, and more preferably 0.15 μm or less.

Examples of the method for applying the undercoat layer (or the intermediate layer) with the coating liquid for forming a charge generation layer include common methods such as a blade coating method, a wire bar coating method, a spray coating method, a dipping coating method, a bead coating method, an air knife coating method, and a curtain coating method.

The film thickness of the charge generation layer is set to be, for example, preferably in the range from 0.1 μm to 5.0 μm, and more preferably in the range from 0.2 μm to 2.0 μm.

Charge Transport Layer

The charge transport layer is, for example, a layer which contains a charge transporting material and a binder resin. The charge transport layer may be a layer which contains a charge transporting polymer material.

Examples of the charge transporting material include electron transporting compounds which include, for example, a quinone compound such as p-benzoquinone, chloranil, bromanil, and anthraquinone; a tetracyanoquinodimethane compound; a fluorenone compound such as 2,4,7-trinitrofluorenone; a xanthone compound; a benzophenone compound; a cyanovinyl compound; and an ethylene compound. Examples of the charge transporting material also include hole transporting material such as a triarylamine compound, a benzidine compound, an arylalkane compound, an aryl substituted ethylene compound, a stilbene compound, an anthracene compound, and a hydrazone compound. The charge transporting material is used singly or in combination of two or more types, and it is not limited thereto.

From a viewpoint of charge mobility, triarylamine derivatives represented by the following formula (a-1) and benzidine derivatives represented by the following formula (a-2) are preferable as the charge transporting material.

(a-1)

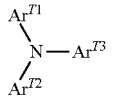

In the formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

As a substituent of each of the groups, a halogen atom, an alkyl group having from 1 to 5 carbon atoms, and an alkoxy group having from 1 to 5 carbon atoms are exemplified. As a substituent of each of the groups, a substituted amino group which has been substituted with an alkyl group having from 1 to 3 carbon atoms is also exemplified.

(a-2)

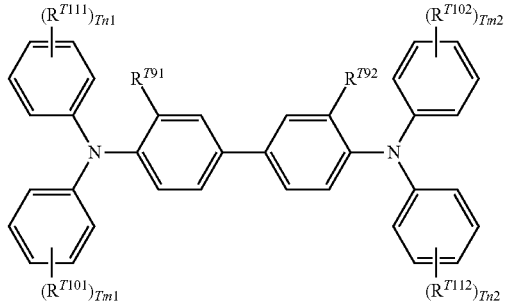

In the formula (a-2), $R^{T91}$ and $R^{T92}$ each independently represent a hydrogen atom, a halogen atom, an alkyl group having from 1 to 5 carbon atoms, or an alkoxy group having from 1 to 5 carbon atoms. $R^{T101}$, $R^{T102}$, $R^{T111}$, and $R^{T112}$ each independently represent a halogen atom, an alkyl group having from 1 to 5 carbon atoms, an alkoxy group having from 1 to 5 carbon atoms, an amino group substituted with an alkyl group having from 1 to 2 carbon atoms, a substituted or unsubstituted aryl group, $—C(R^{T12})=C(R^{T13})(R^{T14})$, or $—CH=CH—CH=C(R^{T15})(R^{T16})$. $R^{T12}$, $R^{T13}$, $R^{T14}$, $R^{T15}$, and $R^{T16}$ each independently represent a hydrogen atom, a substituted or unsubstituted alkyl group, a substituted or unsubstituted aryl group. Tm1, Tm2, Tn1, and Tn2 each independently represent integers of from 0 to 2.

As a substituent of each of the groups, a halogen atom, an alkyl group having from 1 to 5 carbon atoms, and an alkoxy group having from 1 to 5 carbon atoms are exemplified. As a substituent of each of the groups, a substituted amino group which has been substituted with an alkyl group having from 1 to 3 carbon atoms is also exemplified.

Here, among triarylamine derivatives represented by the formula (a-1) and benzidine derivatives represented by the formula (a-2), particularly, triarylamine derivative having "—$C_6H_4$—CH═CH—CH═C($R^{T7}$)($R^{T8}$)", and benzidine derivative having "—CH═CH—CH═C($R^{T15}$)($R^{T16}$)" are preferable from a viewpoint of the charge mobility.

From a viewpoint of charge mobility, examples of the charge transporting material preferably include a butadiene charge transporting material (CT1) represented by the following formula (CT1).

tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, an isoundecyl group, a sec-undecyl group, a tert-undecyl group, a neoundecyl group, an isododecyl group, a sec-dodecyl group, a tert-dodecyl group, a neododecyl group, an isotridecyl group, a sec-tridecyl group, a tert-tridecyl group, a neotridecyl group, an isotetradecyl group, a sec-tetradecyl group, a tert-tetradecyl group, a neotetradecyl group, a 1-isobutyl-4-ethyloctyl group, an isopentadecyl group, a sec-pentadecyl group, a tert-pentadecyl group, a neopentadecyl group, an isohexadecyl group, a sec-hexadecyl group, a tert-hexadecyl group, a neohexadecyl group, a 1-methylpentadecyl group, an isoheptadecyl group, a sec-heptadecyl group, a tert-heptadecyl group, a neoheptadecyl group, an isooctadecyl group, a sec-octadecyl (CT1)

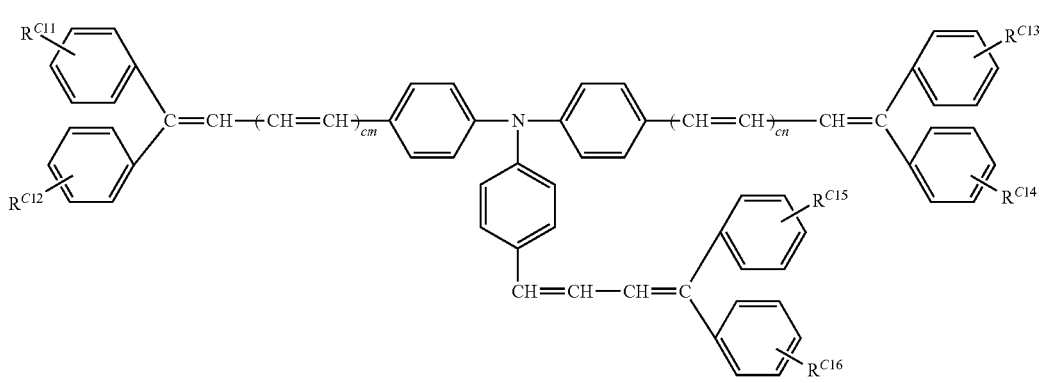

In the formula (CT1), $R^{C11}$, $R^{C12}$, $R^{C13}$, $R^{C14}$, $R^{C15}$, and $R^{C16}$ each independently represent a hydrogen atom, a halogen atom, an alkyl group having from 1 to 20 carbon atoms, an alkoxy group having from 1 to 20 carbon atoms, or an aryl group having from 6 to 30 carbon atoms, and two adjacent substituents may be bonded to each other to form a hydrocarbon ring structure.

cm and cn each independently represent 0, 1, or 2.

In the formula (CT1), examples of the halogen atoms represented by $R^{C11}$, $R^{C12}$, $R^{C13}$, $R^{C14}$, $R^{C15}$, and $R^{C16}$ include a fluorine atom, a chlorine atom, a bromine atom, and an iodine atom. Among these, as the halogen atom, a fluorine atom and a chlorine atom are preferable, and a chlorine atom is more preferable.

In the formula (CT1), examples of the alkyl groups represented by $R^{C11}$, $R^{C12}$, $R^{C13}$, $R^{C14}$, $R^{C15}$, and $R^{C16}$ include a linear or branched alkyl group having from 1 to 20 carbon atoms (preferably having from 1 to 6 carbon atoms, and more preferably having from 1 to 4 carbon atoms).

Specific examples of the linear alkyl group include a methyl group, an ethyl group, a n-propyl group, a n-butyl group, a n-pentyl group, a n-hexyl group, a n-heptyl group, a n-octyl group, a n-nonyl group, a n-decyl group, a n-undecyl group, a n-dodecyl group, a n-tridecyl group, a n-tetradecyl group, a npentadecyl group, a n-hexadecyl group, a n-heptadecyl group, a n-octadecyl group, a n-nonadecyl group, and a n-eicosyl group.

Specific examples of the branched alkyl group include an isopropyl group, an isobutyl group, a sec-butyl group, a tert-butyl group, an isopentyl group, a neopentyl group, a group, a tert-octadecyl group, a neooctadecyl group, an isononadecyl group, a sec-nonadecyl group, a tert-nonadecyl group, a neononadecyl group, a 1-methyloctyl group, an isoeicosyl group, a sec-eicosyl group, a tert-eicosyl group, and a neoeicosyl group.

Among these, lower alkyl groups such as a methyl group, an ethyl group, and an isopropyl group are preferable as the alkyl group.

In the formula (CT1), examples of the alkoxy groups represented by $R^{C11}$, $R^{C12}$, $R^{C13}$, $R^{C14}$, $R^{C15}$, and $R^{C16}$ include a linear or branched alkoxy group having from 1 to 20 carbon atoms (preferably having from 1 to 6 carbon atoms, and more preferably having from 1 to 4 carbon atoms).

Specific examples of the linear alkoxy group include a methoxy group, an ethoxy group, a n-propoxy group, a n-butoxy group, a n-pentyloxy group, a n-hexyloxy group, a n-heptyloxy group, a n-octyloxy group, a n-nonyloxy group, a n-decyloxy group, a n-undecyloxy group, a n-dodecyloxy group, a n-tridecyloxy group, a n-tetradecyloxy group, a n-pentadecyloxy group, a n-hexadecyloxy group, a n-heptadecyloxy group, a n-octadecyloxy group, a n-nonadecyloxy group, and a n-eicosyloxy group.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, a tert-decyloxy group, an isoundecyloxy group, a sec-undecyloxy group, a tert-undecyloxy group, a neoundecyloxy group, an isododecyloxy group, a sec-dodecyloxy group, a tert-dodecyloxy group, a neododecyloxy group, an isotridecyloxy group, a sec-tridecyloxy group, a tert-tridecyloxy group, a neotridecyloxy group, an isotetradecyloxy group, a sec-tetradecyloxy group, a tert-tetradecyloxy group, a neotetradecyloxy group, a 1-isobutyl-4-ethyloctyloxy group, an isopentadecyloxy group, a sec-pentadecyloxy group, a tert-pentadecyloxy group, a neopentadecyloxy group, an isohexadecyloxy group, a sec-hexadecyloxy group, a tert-hexadecyloxy group, a neohexadecyloxy group, a 1-methylpentadecyloxy group, an isoheptadecyloxy group, a sec-heptadecyloxy group, a tert-heptadecyloxy group, a neoheptadecyloxy group, an isooctadecyloxy group, a sec-octadecyloxy group, a tert-octadecyloxy group, a neooctadecyloxy group, an isononadecyloxy group, a sec-nonadecyloxy group, a tert-nonadecyloxy group, a neononadecyloxy group, a 1-methyloctyloxy group, an isoeicosyloxy group, a sec-eicosyloxy group, a tert-eicosyloxy group, and a neoeicosyloxy group.

Among these, a methoxy group is preferable as the alkoxy group.

In the formula (CT1), examples of the aryl groups represented by $R^{C11}$, $R^{C12}$, $R^{C13}$, $R^{C14}$, $R^{C15}$, and $R^{C16}$ include an aryl group having from 6 to 30 carbon atoms (preferably having from 6 to 20 carbon atoms, and more preferably having from 6 to 16 carbon atoms).

Specific examples of the aryl group include a phenyl group, a naphthyl group, a phenanthryl group, and a biphenylyl group.

Among these, a phenyl group and a naphthyl group are preferable as the aryl group.

Furthermore, in the formula (CT1), the respective substituents represented by $R^{C11}$, $R^{C12}$, $R^{C13}$, $R^{C14}$, $R^{C15}$, and $R^{C16}$ also include groups further having substituents. Examples of the substituents include atoms and groups exemplified above (for example, a halogen atom, an alkyl group, an alkoxy group, and an aryl group).

In the formula (CT1), examples of the groups linking the substituents in the hydrocarbon ring structures in which two adjacent substituents (for example, $R^{C11}$ and $R^{C12}$, $R^{C13}$ and $R^{C14}$, and $R^{C15}$ and $R^{C16}$) of $R^{C11}$, $R^{C12}$, $R^{C13}$, $R^{C14}$, $R^{C15}$, and $R^{C16}$ are linked to each other include a single bond, a 2,2'-methylene group, a 2,2'-ethylene group, and a 2,2'-vinylene group, and among these, a single bond and a 2,2'-methylene group are preferable.

Here, specific examples of the hydrocarbon ring structure include a cycloalkane structure, a cycloalkene structure, and a cycloalkanepolyene structure.

In the formula (CT1), cm and cn are preferably 1.

In the formula (CT1), from the viewpoint of forming a photosensitive layer (charge transport layer) having high charge transportability, it is preferable that $R^{C11}$, $R^{C12}$, $R^{C13}$, $R^{C14}$, $R^{C15}$, and $R^{C16}$ each represent a hydrogen atom, an alkyl group having from 1 to 20 carbon atoms, or an alkoxy group having from 1 to 20 carbon atoms, and cm and cn each represent 1 or 2, and it is more preferable that $R^{C11}$, $R^{C12}$, $R^{C13}$, $R^{C14}$, $R^{C15}$, and $R^{C16}$ each represent a hydrogen atom, and cm and cn each represent 1.

That is, it is more preferable that the butadiene charge transport material (CT1) is a charge transport material (exemplary compound (CT1-3)) represented by the following formula (CT1A).

(CT1A)

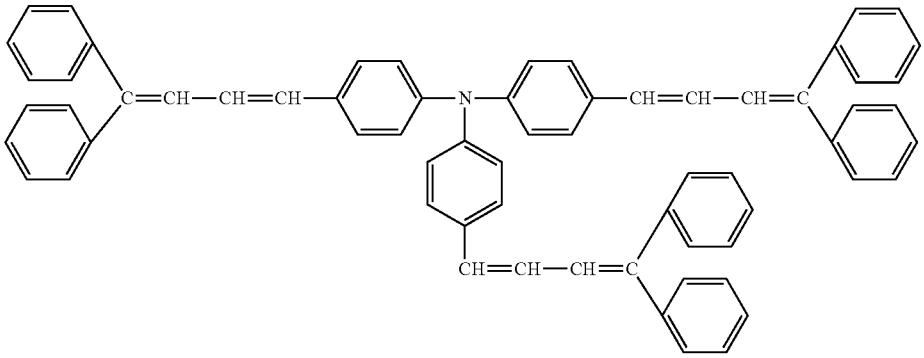

Specific examples of the butadiene charge transport material (CT1) are shown below, and are not limited thereto.

| Exemplary Compound No. | cm | cn | $R^{C11}$ | $R^{C12}$ | $R^{C13}$ | $R^{C14}$ | $R^{C15}$ | $R^{C16}$ |
|---|---|---|---|---|---|---|---|---|
| CT1-1 | 1 | 1 | 4-$CH_3$ | 4-$CH_3$ | 4-$CH_3$ | 4-$CH_3$ | H | H |
| CT1-2 | 2 | 2 | H | H | H | H | 4-$CH_3$ | 4-$CH_3$ |
| CT1-3 | 1 | 1 | H | H | H | H | H | H |
| CT1-4 | 2 | 2 | H | H | H | H | H | H |
| CT1-5 | 1 | 1 | 4-$CH_3$ | 4-$CH_3$ | 4-$CH_3$ | H | H | H |
| CT1-6 | 0 | 1 | H | H | H | H | H | H |
| CT1-7 | 0 | 1 | 4-$CH_3$ | 4-$CH_3$ | 4-$CH_3$ | 4-$CH_3$ | 4-$CH_3$ | 4-$CH_3$ |
| CT1-8 | 0 | 1 | 4-$CH_3$ | 4-$CH_3$ | H | H | 4-$CH_3$ | 4-$CH_3$ |
| CT1-9 | 0 | 1 | H | H | 4-$CH_3$ | 4-$CH_3$ | H | H |
| CT1-10 | 0 | 1 | H | H | 3-$CH_3$ | 3-$CH_3$ | H | H |

-continued

| Exemplary Compound No. | cm | cn | $R^{C11}$ | $R^{C12}$ | $R^{C13}$ | $R^{C14}$ | $R^{C15}$ | $R^{C16}$ |
|---|---|---|---|---|---|---|---|---|
| CT1-11 | 0 | 1 | 4-$CH_3$ | H | H | H | 4-$CH_3$ | H |
| CT1-12 | 0 | 1 | 4-$OCH_3$ | H | H | H | 4-$OCH_3$ | H |
| CT1-13 | 0 | 1 | H | H | 4-$OCH_3$ | 4-$OCH_3$ | H | H |
| CT1-14 | 0 | 1 | 4-$OCH_3$ | H | 4-$OCH_3$ | H | 4-$OCH_3$ | 4-$OCH_3$ |
| CT1-15 | 0 | 1 | 3-$CH_3$ | H | 3-$CH_3$ | H | 3-$CH_3$ | H |
| CT1-16 | 1 | 1 | 4-$CH_3$ | 4-$CH_3$ | 4-$CH_3$ | 4-$CH_3$ | 4-$CH_3$ | 4-$CH_3$ |
| CT1-17 | 1 | 1 | 4-$CH_3$ | 4-$CH_3$ | H | H | 4-$CH_3$ | 4-$CH_3$ |
| CT1-18 | 1 | 1 | H | H | 4-$CH_3$ | 4-$CH_3$ | H | H |
| CT1-19 | 1 | 1 | H | H | 3-$CH_3$ | 3-$CH_3$ | H | H |
| CT1-20 | 1 | 1 | 4-$CH_3$ | H | H | H | 4-$CH_3$ | H |
| CT1-21 | 1 | 1 | 4-$OCH_3$ | H | H | H | 4-$OCH_3$ | H |
| CT1-22 | 1 | 1 | H | H | 4-$OCH_3$ | 4-$OCH_3$ | H | H |
| CT1-23 | 1 | 1 | 4-$OCH_3$ | H | 4-$OCH_3$ | H | 4-$OCH_3$ | 4-$OCH_3$ |
| CT1-24 | 1 | 1 | 3-$CH_3$ | H | 3-$CH_3$ | H | 3-$CH_3$ | H |

Furthermore, the abbreviated symbols in the exemplary compounds represent the following meanings. Further, the numbers attached before the substituents represent the substitution positions with respect to the benzene ring.

—$CH_3$: Methyl group

—$OCH_3$: Methoxy group

The butadiene charge transport material (CT1) may be used alone or in combination of two or more kinds thereof.

From a viewpoint of the charge mobility, examples of the charge transporting material preferably include a benzidine charge transporting material (CT2) represented by the following formula (CT2). In particular, from a viewpoint of the charge mobility, the butadiene charge transporting material (CT1) and the benzidine charge transporting material (CT2) are preferably used together, as the charge transporting material.

(CT2)

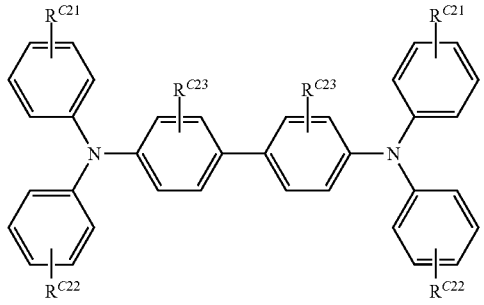

In the formula (CT2) , $R^{C21}$, $R^{C22}$, and $R^{C23}$ each independently represent a hydrogen atom, a halogen atom, an alkyl group having from 1 to 10 carbon atoms, an alkoxy group having from 1 to 10 carbon atoms, or an aryl group having from 6 to 10 carbon atoms.

In the formula (CT2), examples of the halogen atoms represented by $R^{C21}$, $R^{C22}$, and $R^{C23}$ include a fluorine atom, a chlorine atom, a bromine atom, and an iodine atom. Among these, as the halogen atom, a fluorine atom and a chlorine atom are preferable, and a chlorine atom is more preferable.

In the formula (CT2), examples of the alkyl groups represented by $R^{C21}$, $R^{C22}$, and $R^{C23}$ include a linear or branched alkyl group having from 1 to 10 carbon atoms (preferably having from 1 to 6 carbon atoms, and more preferably having from 1 to 4 carbon atoms).

Specific examples of the linear alkyl group include a methyl group, an ethyl group, a n-propyl group, a n-butyl group, a n-pentyl group, a n-hexyl group, a n-heptyl group, a n-octyl group, a n-nonyl group, and a n-decyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

Among these, lower alkyl groups such as a methyl group, an ethyl group, and an isopropyl group are preferable as the alkyl group.

In the formula (CT2), examples of the alkoxy groups represented by $R^{C21}$, $R^{C22}$, and $R^{C23}$ include a linear or branched alkoxy group having from 1 to 10 carbon atoms (preferably having from 1 to 6 carbon atoms, and more preferably having from 1 to 4 carbon atoms).

Specific examples of the linear alkoxy group include a methoxy group, an ethoxy group, a n-propoxy group, a n-butoxy group, a n-pentyloxy group, a n-hexyloxy group, a n-heptyloxy group, a n-octyloxy group, a n-nonyloxy group, and a n-decyloxy group.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, and a tert-decyloxy group.

Among these, a methoxy group is preferable as the alkoxy group.

In the formula (CT2), examples of the aryl groups represented by $R^{C21}$, $R^{C22}$, and $R^{C23}$ include an aryl group having from 6 to 10 carbon atoms (preferably having from 6 to 9 carbon atoms, and more preferably having from 6 to 8 carbon atoms).

Specific examples of the aryl group include a phenyl group and a naphthyl group.

Among these, a phenyl group is preferable as the aryl group.

Moreover, in the formula (CT2), the respective substituents represented by $R^{C21}$, $R^{C22}$, and $R^{C23}$ also include groups further having substituents. Examples of the substituents include atoms and groups exemplified above (for example, a halogen atom, an alkyl group, an alkoxy group, and an aryl group).

In the formula (CT2), particularly from the viewpoint of forming a photosensitive layer (charge transport layer) having high charge transportability (improving sensitivity of the photoreceptor), it is preferable that $R^{C21}$, $R^{C22}$, and $R^{C23}$ each independently represent a hydrogen atom or an alkyl group having from 1 to 10 carbon atoms, and it is more preferable that $R^{C21}$ and $R^{C23}$ represent a hydrogen atom, and $R^{C22}$ represents an alkyl group having from 1 to 10 carbon atoms (particularly a methyl group).

Specifically, it is particularly preferable that the benzidine charge transport material (CT2) is a charge transport material (exemplary compound (CT2-2)) represented by the following formula (CT2A).

(CT2A)

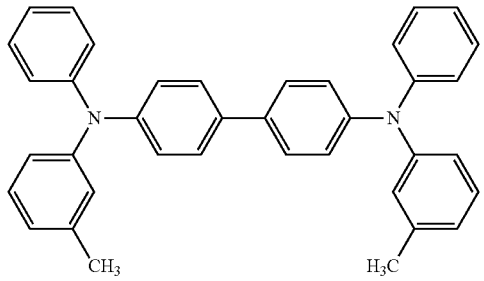

Specific examples of the benzidine charge transport material (CT2) are shown below, and are not limited thereto.

| Exemplary Compound No. | $R^{C21}$ | $R^{C22}$ | $R^{C23}$ |
|---|---|---|---|
| CT2- 1 | H | H | H |
| CT2- 2 | H | 3-$CH_3$ | H |
| CT2- 3 | H | 4-$CH_3$ | H |
| CT2- 4 | H | 3-$C_2H_5$ | H |
| CT2- 5 | H | 4-$C_2H_5$ | H |
| CT2- 6 | H | 3-$OCH_3$ | H |
| CT2- 7 | H | 4-$OCH_3$ | H |
| CT2- 8 | H | 3-$OC_2H_5$ | H |
| CT2- 9 | H | 4-$OC_2H_5$ | H |
| CT2-10 | 3-$CH_3$ | 3-$CH_3$ | H |
| CT2-11 | 4-$CH_3$ | 4-$CH_3$ | H |
| CT2-12 | 3-$C_2H_5$ | 3-$C_2H_5$ | H |
| CT2-13 | 4-$C_2H_5$ | 4-$C_2H_5$ | H |
| CT2-14 | H | H | 2-$CH_3$ |
| CT2-15 | H | H | 3-$CH_3$ |
| CT2-16 | H | 3-$CH_3$ | 2-$CH_3$ |
| CT2-17 | H | 3-$CH_3$ | 3-$CH_3$ |
| CT2-18 | H | 4-$CH_3$ | 2-$CH_3$ |
| CT2-19 | H | 4-$CH_3$ | 3-$CH_3$ |
| CT2-20 | 3-$CH_3$ | 3-$CH_3$ | 2-$CH_3$ |
| CT2-21 | 3-$CH_3$ | 3-$CH_3$ | 3-$CH_3$ |
| CT2-22 | 4-$CH_3$ | 4-$CH_3$ | 2-$CH_3$ |
| CT2-23 | 4-$CH_3$ | 4-$CH_3$ | 3-$CH_3$ |

Furthermore, the abbreviated symbols in the exemplary compounds represent the following meanings. Further, the numbers attached before the substituents represent the substitution positions with respect to the benzene ring.

—$CH_3$: Methyl group

—$C_2H_5$: Ethyl group

—$OCH_3$: Methoxy group

—$OC_2H_5$: Ethoxy group

The benzidine charge transport material (CT2) may be used alone or in combination of two or more kinds thereof.

As the charge transporting polymer material, known materials having charge transporting properties, such as poly-N-vinylcarbazole and polysilane are used. In particular, a polyester charge transporting polymer material is particularly preferable. The charge transporting polymer material may be singly used, or may be used along with a binder resin.

Examples of the binder resin used in the charge transport layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, polycarbonate resins or polyarylate resins are suitable as the binder resin. These binder resins may be used alone or in combination of two or more kinds thereof.

In addition, the blend ratio of the charge transport material to the binder resin is preferably from 10:1 to 1:5 in terms of weight ratio.

The charge transport layer may contain other known additives.

Examples of the additive contained in the charge transport layer include fluorine-containing resin particles, a fluorine-containing dispersion, and an antioxidant.

The fluorine-containing resin particle will be described.

For example, the fluorine-containing resin particle is preferably one type or two or more types selected from particles of tetrafluoroethylene resins, chlorotrifluoroethylene resins, hexafluoropropylene resins, vinyl fluoride resins, vinylidene fluoride resins, difluoro-dichloride ethylene resins, and copolymers thereof. Among these substances, as the fluorine-containing resin particle, particularly, tetrafluoroethylene resin particles and vinylidene fluoride resin particles are preferable.

The number average particle diameter of the fluorine-containing resin particles may be from 0.05 μm to 1 μm, and preferably from 0.1 μm to 0.5 μm.

A sample piece is obtained from a photosensitive layer (charge transport layer). The obtained sample piece is observed at magnification of, for example, 5,000 or more, by a scanning electron microscope (SEM). The largest diameter of each of fluorine resin particles in a state of primary particles is measured, and the measuring is performed for 50 particles so as to obtain an average value. JSM-6700F manufactured by Jeol Ltd. is used as the SEM and a secondary electron image at an acceleration voltage of 5 kV is observed.

Examples of a commercial product of the fluorine-containing resin particles include LUBRON (registered trademark) series (manufactured by Daikin Industries, Ltd.), TEFLON (registered trademark) series (manufactured by Du Pont corporation), and DYNEON (registered trademark) series (manufactured by 3M corporation).

The content of the fluorine-containing resin particles is preferably from 1% by weight to 30% by weight, more preferably from 3% by weight to 20% by weight, and further preferably from 5% by weight to 15% by weight, with respect to the total solid content of the charge transport layer.

The fluorine-containing dispersion will be described.

The fluorine-containing dispersion is used as a dispersion stabilizer of the fluorine-containing resin particles in a coating liquid for forming a charge transport layer, for example.

Examples of the fluorine-containing dispersion include a polymer (also referred to as "a fluorinated alkyl group-containing polymer" below) obtained in such a manner that a polymerizable compound having a fluorinated alkyl group is singly polymerized or copolymerized.

Specific examples of the fluorine-containing dispersion include a single polymer of (meth) acrylate having a fluorinated alkyl group, and a random or block copolymer of (meth) acrylate having a fluorinated alkyl group, and a monomer which does not have a fluorine atom. (Meth) acrylate means both of acrylate and methacrylate.

Examples of the (meth)acrylate having a fluorinated alkyl group include 2,2,2-trifluoroethyl (meth)acrylate and 2,2,3,3,3-pentafluoropropyl (meth)acrylate.

Examples of the monomer which does not have a fluorine atom include (meth)acrylate, isobutyl (meth)acrylate, t-butyl (meth)acrylate, isooctyl (meth)acrylate, lauryl (meth)acrylate, stearyl (meth)acrylate, isobornyl (meth)acrylate, cyclohexyl (meth)acrylate, 2-methoxyethyl (meth)acrylate, methoxy triethylene glycol (meth)acrylate, 2-ethoxyethyl (meth)acrylate, tetrahydrofurfuryl (meth)acrylate, benzyl (meth)acrylate, ethyl carbitol (meth)acrylate, phenoxyethyl (meth)acrylate, 2-hydroxy (meth)acrylate, 2-hydroxypropyl (meth)acrylate, 4-hydroxybutyl (meth)acrylate, methoxypolyethylene glycol (meth)acrylate, phenoxy polyethylene glycol (meth)acrylate, hydroxyethyl o-phenylphenol (meth) acrylate, and o-phenylphenol glycidyl ether (meth)acrylate.

In addition, a specific example of the fluorine-containing dispersion also includes a block or branch polymer. Further, the specific example of the fluorine-containing dispersion also includes a fluorine surfactant.

Examples of a commercial product of the fluorine-containing dispersion include GF300 and GF400 (manufactured by Toagosei Co., Ltd.), SURFLON (registered trademark) series (manufactured by AGC Seimi chemical Co., Ltd.), FTERGENT series (manufactured by Neos Co., Ltd.), PF series (manufactured by Kitamura Chemicals Co., Ltd.), MEGAFACE (registered trademark) series (manufactured by DIC Corporation), and FC series (manufactured by 3M Corporation).

The weight average molecular weight of the fluorine-containing dispersion is, for example, preferably from 2000 to 250000, more preferably from 3,000 to 150,000, and further preferably from 20,000 to 100,000.

The weight average molecular weight of the fluorine-containing dispersion has a value measured by gel permeation chromatography (GPC). When the molecular weight is measured by GPC, for example, GPC-HLC-8120 manufactured by Tosoh Corporation is used as a measuring device. The measuring is performed in a chloroform solvent by using Column-TSKgel GMHHR-M and TSKgel GMHHR-M (7.8 mm I.D.30 cm) which are manufactured by Tosoh Corporation. The molecular weight is calculated from the measurement result by using a molecular weight calibration curve which has been obtained by a monodispersion polystyrene standard sample.

The content of the fluorinated alkyl group-containing copolymer is, for example, preferably from 0.5% by weight to 10% by weight, more preferably from 1% by weight to 7% by weight, and further preferably from 1% by weight to 5% by weight, with respect to the weight of the fluorine-containing resin particles.

The fluorinated alkyl group-containing copolymer may be used alone or as a mixture of two or more kinds thereof.

The antioxidant will be described.

Representative examples of the antioxidant include a substance having properties of preventing an action of oxygen on an oxidizing substance which is provided in or on a surface of the electrophotographic photoreceptor, under conditions of light, heat, discharge, and the like.

Examples of the antioxidant include a radical polymerization inhibitor and a peroxide decomposer. Examples of the radical polymerization inhibitor include known antioxidants such as a hindered phenol antioxidant, a hindered amine antioxidant, a diallylamine antioxidant, a diallyl diamine antioxidant, and a hydroquinone antioxidant. Examples of the peroxide decomposer include known antioxidants such as an organic sulfur (for example, thioether) antioxidant, a phosphoric acid antioxidant, a dithiocarbamate antioxidant, a thiourea antioxidant, and a benzimidazole antioxidant.

Among these substances, the radical polymerization inhibitor may be used as the antioxidant, and particularly, the hindered phenol antioxidant and the hindered amine antioxidant are preferable. As the antioxidant, an antioxidant having two or more different skeletons which have an oxidation preventing action (for example, antioxidant and the like having a hindered phenol skeleton and a hindered amine skeleton) may be used.

The hindered phenol antioxidant will be described.

The hindered phenol antioxidant is a compound having a hindered phenol ring.

In the hindered phenol antioxidant, the hindered phenol ring is, for example, a phenol ring in which at least one alkyl group having from 4 to 8 carbon atoms (for example, branched alkyl group having from 4 to 8 carbon atoms) is substituted. More specifically, the hindered phenol ring is, for example, a phenol ring in which substitution with a tertiary alkyl group (for example, tert-butyl group) is performed at a position which is orthogonal to a phenolic hydroxyl group.

Examples of the hindered phenol antioxidant include 1) an antioxidant having one hindered phenol ring; 2) an antioxidant which has from 2 to 4 hindered phenol rings, and in which the from 2 to 4 hindered phenol rings are linked to each other by a linking group formed from linear or branched aliphatic hydrocarbon groups of being divalent to being tetravalent, or by a linking group for inserting at least one of an ester bond (—C(=O)O—) and an ether bond (—O—) into a carbon-carbon bond of the aliphatic hydrocarbon group of being divalent to being tetravalent; and 3) an antioxidant which has from 2 to 4 hindered phenol rings, and one benzene ring (unsubstituted benzene ring, or substituted benzene ring obtained by being substituted with an alkyl group and the like) or an isocyanurate ring, and in which each of the from 2 to 4 hindered phenol rings are linked to the benzene ring or the isocyanurate ring through an alkylene group.

Specific examples of the hindered phenol antioxidant include 2,6-di-t-butyl-4-methylphenol, styrenated phenol, 3,5-di-t-butyl-4-hydroxybiphenyl, n-octadecyl-3-(3',5'-di-t-butyl-4,5'-hydroxyphenyl)-propionate, 2,2'-methylene bis (6-t-butyl-4-methylphenol), 2-t-butyl-6-(3'-t-butyl-5'-methyl-2'-hydroxybenzyl)-4-methylphenyl acrylate, 4,4'-butylidene-bis-(3-methyl-6-t-butylphenol), 4,4'-thio-bis-(3-methyl-6-t-butylphenol), 1,3,5-tris(4-t-butyl-3-hydroxy-2,6-dimethylbenzyl)isocyanurate, tetrakis-[methylene-3-(3', 5',-di-t-butyl-4'-hydroxyphenyl)propionate]methane, and 3,9-bis[2-[3-(3-t-butyl-4-hydroxy-5-methylphenyl) propionyloxy]-1,1-dimethylethyl]-2,4,8,10-tetraoxaspiro[5,5]undecane.

Examples of a commercial product of the hindered phenol antioxidant include IRGANOX 1076, IRGANOX 1010, IRGANOX 1098, IRGANOX 245, IRGANOX 1330, IRGANOX 3114, and IRGANOX 1076 (all, manufactured by BASF Japan Corp.), and SUMILIZER MDP-S (manufactured by Sumitomo Chemical Co., Ltd.)

The hindered amine antioxidant will be described.

The hindered amine antioxidant is an antioxidant having a hindered amine skeleton.

Examples of the hindered amine skeleton include a piperidyle skeleton substituted with an alkyl group. Specific examples of the hindered amine skeleton include a tetraalkylpiperidyle skeleton in which each of two hydrogen atoms bonded to a carbon atom at a position orthogonal to a nitrogen atom is substituted with an alkyl group. In the tetraalkylpiperidyle skeleton, the hydrogen atom bonded to a nitrogen atom may be substituted with an alkyl group or an alkoxy group.

Specific examples of the hindered amine antioxidant include bis (2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, dimethyl succinate-1-(2-hydroxyethyl)-4-hydroxy-2,2,6,6-tetramethyl piperidine polycondensate, poly[{6-(1,1,3,3-tetramethylbutyl)imino-1,3,5-triazine-2,4-diimil}{(2,2,6,6-tetramethyl-4-piperidyl)imino}hexamethylene{(2,3,6,6-tetramethyl-4-piperidyl)imino}], 2-(3,5-di-t-butyl-4-hydroxybenzyl)-2-n-butyl malonic acid bis (1,2,2,6,6-pentamethyl-4-piperidyl), and N,N'-bis(3-aminopropyl)ethylenediamine-2,4-bis[N-butyl-N-(1,2,2,6,6-pentamethyl-4-piperidyl)amino]-6-chloro-1,3,5-triazine condensate.

Examples of a commercial product of the hindered amine antioxidant include SANOL LS2626, SANOL LS765. SANOL LS770, and SANOL LS744 (all, manufactured by Daiichi sankyo Co., Ltd.), TINUVIN 144 and TINUVIN 622LD (all, manufactured by BASF Japan) , and MARK LA57, MARK LA67, MARK LA62, MARK LA68, and MARK LA63 (all, manufactured by Adeka Corp.).

Examples of the organic sulfur antioxidant include dilauryl-3,3'-thiodipropionate, dimyristyl-3,3'-thiodipropionate, distearyl-3,3'-thiodipropionate, pentaerythritol-tetrakis-(β-lauryl-thiopropionate), ditridecyl-3,3'-thiodipropionate, and 2-mercaptobenzimidazole.

Examples of a commercial product of the thioether antioxidant include SUMILIZER TPS and SUMILIZER TP-D (all, manufactured by Sumitomo Chemical Co., Ltd.). Examples of the phosphite antioxidant include MARK 2112, MARK PEP-8, MARK PEP-24G, MARK PEP-36, MARK 329K, and MARK HP-10 (all, manufactured by Adeka Corp.).

Specific examples of the phosphoric acid antioxidant include tris nonylphenyl phosphite, triphenyl phosphite, and tris(2,4-di-t-butylphenyl)-phosphite.

The organic sulfur antioxidant and the phosphoric acid antioxidant are referred to as secondary antioxidants. The secondary antioxidant is used along with the primary antioxidant such as the phenol antioxidant or the amine antioxidant, and thus a synergy effect is obtained.

The antioxidant may be singly used or be used in combination of two or more types.

A technique for forming the charge transport layer is not particularly limited, and known forming methods are used. For example, formation of the charge transport layer is carried out by forming a coating film of a coating liquid for forming a charge transport layer, prepared by adding the components to a solvent, and then drying the coating film, followed by heating as desired.

Examples of the solvent for preparing the coating liquid for forming a charge transport layer are common organic solvents including, for example, aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. These solvents may be used alone or as a mixture of two or more kinds thereof.

Examples of a coating method used in coating the charge generation layer with the coating liquid for forming a charge transport layer include common methods such as a blade coating method, a wire bar coating method, a spray coating method, a dipping coating method, a bead coating method, an air knife coating method, and a curtain coating method.

The film thickness of the charge transport layer is, for example, set to be in the range preferably from 5 μm to 50 μm and more preferably from 10 μm to 30 μm.

Protective Layer

The protective layer is provided on the photosensitive layer, as desired. The protective layer is provided, for example, for the purpose of preventing the chemical changes of the photosensitive layer during charging, and further improving the mechanical strength of the photosensitive layer.

Accordingly, as the protective layer, a layer formed of a cured film (crosslinked film) may be applied. Examples of this layer include the layers described in 1) and 2) below.

1) A layer formed of a cured film of a composition that includes a reactive group-containing charge transport material that has a reactive group and a charge transporting skeleton in the same molecule (that is, a layer that includes a polymer or a crosslinked product of the reactive group-containing charge transport material)

2) A layer formed of a cured film of a composition that includes an unreactive charge transport material and a reactive group-containing non-charge transport material that has no charge transporting skeleton but has a reactive group (that is, a layer that includes a polymer or a crosslinked product of an unreactive charge transport material and a reactive group-containing non-charge transport material).

Examples of the reactive group of the reactive group-containing charge transport material include known reactive groups such as a chain polymerizable group, an epoxy group, —OH, —OR [in which R represents an alkyl group], $—NH_2$, —SH, —COOH, and $—SiR^{Q1}_{3-Qn}(OR^{Q2})_{Qn}$ [in which $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of from 1 to 3].

The chain polymerizable group is not particularly limited as long it is a radically polymerizable functional group. For example, it is a functional group which has at least a group containing a carbon-carbon double bond. Specific examples thereof include a group that contains at least one selected from the group consisting of a vinyl group, a vinyl ether group, a vinyl thioether group, a vinylphenyl group, an acryloyl group, a methacryloyl group, and derivatives thereof. Among these, a group that contains at least one selected from the group consisting of a vinyl group, a vinylphenyl group, an acryloyl group, a methacryloyl group, and derivatives thereof is preferable as the chain polymerizable group from the viewpoint of its excellent reactivity.

The charge transporting skeleton of the reactive group-containing charge transport material is not particularly limited as long as it is a known structure for an electrophotographic photoreceptor. Examples thereof include skeletons derived from nitrogen-containing hole transport compounds such as triarylamine compounds, benzidine compounds, and hydrazone compounds, in which the structure is conjugated with a nitrogen atom. Among these, a triarylamine skeleton is preferable.

The reactive group-containing charge transport material having a reactive group and a charge transporting skeleton, the unreactive charge transport material, and the reactive group-containing non-charge transport material may be selected from known materials.

The protective layer may further include other known additives.

A technique for forming the protective layer is not particularly limited, and known methods are used. For example, the formation is carried out by forming a coating film from a coating liquid for forming a protective layer, prepared by adding the components to a solvent, and drying the coating film, followed by a curing treatment such as heating, as desired.

Examples of the solvent used for preparing the coating liquid for forming a protective layer include aromatic solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethyl ether; and alcohol solvents such as isopropyl alcohol and butanol. These solvents may be used alone or as a mixture of two or more kinds thereof.

Furthermore, the coating liquid for forming a protective layer may be a solvent-free coating liquid.

Examples of the coating method used for coating the photosensitive layer (for example, the charge transport layer) with the coating liquid for forming a protective layer include common methods such as a dipping coating method, a lift coating method, a wire bar coating method, a spray coating method, a blade coating method, a knife coating method, and a curtain coating method.

The film thickness of the protective layer is set to be, for example, preferably in the range from 1 μm to 20 μm, and more preferably in the range from 2 μm to 10 μm.

Single-Layer Type Photosensitive Layer

The single-layer type photosensitive layer (charge generation/charge transport layer) is a layer which contains, for example, a charge generating material, a charge transporting material, and, if necessary, a binder resin and other well-known additives. These materials are similar to the materials described for the charge generation layer and the charge transport layer.

The content of the charge generating material in the single-layer type photosensitive layer may be from 10% by weight to 85% by weight, with respect to the total solid content. The content of the charge generating material is preferably from 20% by weight to 50% by weight. The content of the charge transporting material in the single-layer type photosensitive layer may be from 5% by weight to 50% by weight with respect to the total solid content.

A forming method of the single-layer type photosensitive layer is similar to the forming method of the charge generation layer or the charge transport layer.

The film thickness of the single-layer type photosensitive layer may be, for example, from 5 μm to 50 μm. The film thickness of the single-layer type photosensitive layer is preferably from 10 μm to 40 μm.

Charging Device

As the charging device 8, for example, a contact type charger which uses a conductive or semiconductive charging roller, a charging brush, a charging film, a charging rubber blade, a charging tube, or the like is used. Further, known chargers such as a roller charger of a non-contact type, a scorotron charger or a corotron charger using corona discharge are also used.

Exposure Device

Examples of the exposure device 9 include optical system equipment and the like which exposes the surface of the electrophotographic photoreceptor 7 with light such as a semiconductor laser beam, LED light, and liquid crystal shutter light, so as to have a defined form. The wavelength of the light source is defined to be in a spectral sensitivity region of the electrophotographic photoreceptor. For the wavelength of the semiconductor laser light, the near-infrared ray having an emission wavelength at near 780 nm is used as the mainstream. However, the wavelength of the light source is not limited to this wavelength. A laser having a wavelength in the band of 600 nm, or a blue laser having a wavelength from 400 nm to 450 nm may also be used. A surface light-emitting type laser light source that may output multiple beams is also available for forming a color image.

Developing Device

Examples of the developing device 11 include a general developing device which performs developing by using a developer in a contact manner or a noncontact manner. The developing device 11 is not particularly limited as long as the device has the above-described function, and the developing device 11 is selected on purposes. For example, known developing devices which have a function of adhering a single-component developer or a two-component developer to the electrophotographic photoreceptor 7 by using a brush, a roller, and the like are exemplified. Among the devices, a device using a developing roller of which a developer is held on a surface is preferable.

The developer used in the developing device 11 may be a single-component developer configured by a toner alone, or a two-component developer that includes a toner and a carrier. The developer may be magnetic or nonmagnetic. As the developer, well-known developers are applied.

Cleaning Device

As the cleaning device 13, a cleaning blade type device which includes a cleaning blade 131 is used.

In addition to the cleaning blade type, a fur brush cleaning type and a developing and simultaneous cleaning type may be employed.

Intermediate Transfer Member

As the intermediate transfer member 50, a belt-shaped transfer member (intermediate transfer belt) containing polyimide, polyamideimide, polycarbonate, polyarylate, polyester, rubber, or the like, which have been imparted with semiconductivity, is used. As a shape of the intermediate transfer member, a transfer member having a drum shape may be used in addition to the belt-shaped transfer member.

Transfer Device

Examples of the transfer device 40 include known transfer chargers such as a contact-type transfer charger using a belt, a roller, a film, a rubber blade, or the like, and scorotron transfer chargers and corotron transfer chargers which utilize corona discharge.

A power source (not illustrated) applies a transfer voltage of polarity opposite to the polarity of the toner, to the transfer device 40, and thus a transfer current (primary transfer current) flows between the transfer device 40 and the electrophotographic photoreceptor 7, and a toner image on the electrophotographic photoreceptor 7 is transferred to the intermediate transfer member 50.

In the exemplary embodiment, the primary transfer current value is assumed to be from 80 μA to 160 μA. The primary transfer current value is in the above range, and thus poor transfer is prevented in comparison to a case of being smaller than the above range. The primary transfer current value is in the above range, and thus ghost is prevented in comparison to a case of being larger than the above range.

The primary transfer current value is preferably from 80 μA to 120 μA, from a viewpoint of achieving prevention of the poor transfer and prevention of the occurrence of ghost.

The secondary transfer device (not illustrated) has a configuration similar to that of the transfer device 40 except for transferring the toner image on the intermediate transfer member 50, to a recording medium.

Figure 4:
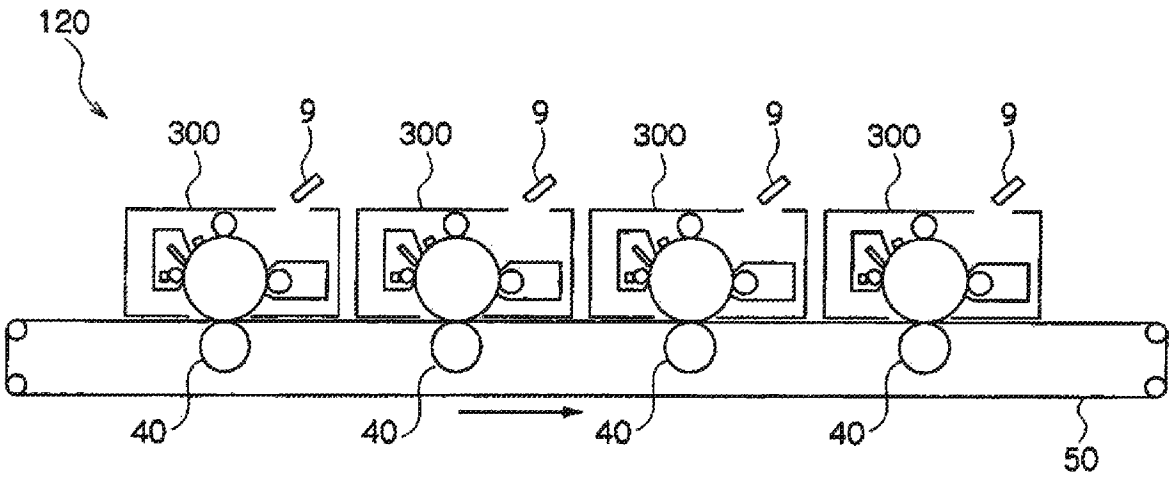
FIG. 4 is a schematic configuration diagram illustrating another example of the image forming apparatus according to the exemplary embodiment.

FIG. 4 is a schematic configuration diagram illustrating another example of the image forming apparatus according to the exemplary embodiment.

An image forming apparatus 120 illustrated in FIG. 4 is a tandem type multi-color image forming apparatus in which four process cartridges 300 are mounted. The image forming apparatus 120 has a configuration in which the four process cartridges 300 are disposed in parallel on the intermediate transfer member 50, and one electrophotographic photoreceptor is used per color. Further, the image forming apparatus 120 has a configuration similar to that of the image forming apparatus 100, except for being a tandem type.

The image forming apparatus according to the exemplary embodiment is not limited to the configurations illustrated in FIGS. 1 and 4, as described above. Specifically, other components may employ known components as long as the above-described photoreceptor having an undercoat layer in which electrostatic capacitance per unit area is in the above range, the above-described intermediate transfer member of which volume resistivity is in the above range, and the above-described primary transfer unit of which the primary transfer current value is in the above range are provided.

EXAMPLES

The exemplary embodiment will be described below in detail by using examples. The exemplary embodiment is not limited to the examples. In the following description, "part(s)" and "%" are all based on weight unless otherwise specified.

Preparation of Photoreceptor

Photoreceptor 1

Formation of Undercoat Layer 100 parts by weight of zinc oxide (volume average particle diameter: 70 nm, manufactured by Tayca Corporation, and BET specific surface area: 15 $m^2/g$) as metal oxide particles are mixed with 500 parts by weight of methanol, while stirring. 1.25 parts by weight of KBM603 (manufactured by Shin-Etsu Chemical Co., Ltd.) as a silane coupling agent are added to the above mixture, and stirring is performed for 2 hours. Then, methanol is removed by distillation under reduced pressure, and the residue is subjected to a baking surface treatment at 120° C. for 3 hours. Thus, zinc oxide particles which are subjected to surface treatment with the silane coupling agent are obtained.

44.6 parts by weight of the zinc oxide particles which are subjected to surface treatment with the silane coupling agent, 0.45 parts by weight of "an exemplary compound (1-1) of hydroxyanthraquinone as an electron accepting compound, 10.2 parts by weight of blocked isocyanate (product name: SUMIDUR 3173 manufactured by Sumitomo Bayer Urethane Co., Ltd.) as a curing agent, 3.5 parts by weight of a butyral resin (product name: S-LEC BM-1, manufactured by Sekisui Chemical Co., Ltd.), 0.005 parts by weight of dioctyl tin dilaurate as a catalyst, and 41.3 parts by weight of methyl ethyl ketone are mixed. The mixture is dispersed for 4 hours (that is, dispersion time: 4 hours) in a sand mill which uses glass beads having a diameter of 1 mm, thereby obtaining a dispersion. 3.6 parts by weight of silicone resin particles (TOSPEARL 145, manufactured by Momentive Performance Materials Inc.) are added to the obtained dispersion, and thus a coating liquid for forming an undercoat layer is obtained. The viscosity of the coating liquid for forming an undercoat layer at a coating temperature of 24° C. is 235 mPa·s.

An aluminum substrate (electroconductive substrate) having a diameter of 30 mm, a length of 357 mm, and a thickness of 1.0 mm is coated with the coating liquid for forming an undercoat layer by a dipping coating method. The coating is performed at a coating speed of 220 mm/min. Then, dry curing is performed at 190° C. for 24 minutes, thereby obtaining an undercoat layer having a thickness of 19 μm.

Formation of Charge Generation Layer 15 parts by weight of a hydroxygallium phthalocyanine pigment as a charge generating material, 10 parts by weight of a vinyl chloride-vinyl acetate copolymer resin (product name: VMCH, manufactured by NUC Ltd.) as a binder resin, and 300 parts by weight of n-butyl alcohol as a solvent are mixed. The hydroxygallium phthalocyanine pigment has strong diffraction peaks at at least 7.5°, 9.9°, 12.5°, 16.3°, 18.6°, 25.1°, and 28.3° of Bragg angles (2θ±0.2°) for CuKα characteristic X-rays. The mixture is dispersed in a sand mill using glass beads for 4 hours, thereby obtaining a coating liquid for forming a charge generation layer. The glass beads have a diameter of 1 mm. The viscosity of the coating liquid for forming a charge generation layer at a coating temperature of 24° C. is 1.8 mPa·s. The obtained coating liquid for forming a charge generation layer is applied onto the undercoat layer at a coating speed of 65 mm/min by dipping coating. Drying is performed at 150° C. for 5 minutes, thereby obtaining a charge generation layer having a film thickness of 0.1 μm.

Formation of Charge Transport Layer 8 parts by weight (number average particle diameter: 0.2 μm) of tetrafluoroethylene resin particles as fluorine-containing resin particles, 0.01 parts by weight of GF400 (manufactured by Toagosei Co., Ltd., surfactant in which at least methacrylate having a fluorinated alkyl group is used as a polymerization component) as a fluorine-containing dispersion are mixed with 4 parts by weight of tetrahydrofuran and 1 part by weight of toluene. The mixing is performed with stirring for 48 hours, while being maintained at a liquid temperature of 20° C. Thus, a tetrafluoroethylene resin particle suspension A is obtained.

Then, 1.6 parts by weight of "an exemplary compound (CT1-3)" of a butadiene charge transport material (CT1) as a charge transport substance, 3 parts by weight of N,N'-bis (3-methylphenyl)-N,N'-diphenyl benzidine, 6 parts by weight of a polycarbonate copolymer (pm:pn=25:75, weight average molecular weight: 53000) represented by the following formula (PC-1), as a binder resin, and 0.1 parts by weight of 2,6-di-t-butyl-4-methylphenol as an antioxidant are mixed. The mixture is mixed and dissolved with 24 parts by weight of tetrahydrofuran and 11 parts by weight of toluene which are used as a solvent. Thus, a mixed solution B is obtained.

The tetrafluoroethylene resin particle suspension A liquid is added to the mixed solution B liquid, and mixing and stirring is performed. Then, pressing is performed up to 500 kgf/cm$^2$ and a dispersing treatment is repeated six times by using a high pressure homogenizer (manufactured by Yoshida kikai Co., Ltd.), and thus a liquid is obtained. The high pressure homogenizer has a penetration-type chamber which is mounted therein and has a minute flow path. 5 ppm of ether-modified silicone oil (product name: KP340 manufactured by Shin-Etsu Chemical Co., Ltd.) is added to the obtained liquid. Stirring is sufficiently performed, thereby obtaining a coating liquid for forming a charge transport layer. The coating liquid for forming a charge transport layer is applied onto the charge generation layer so as to have a thickness of 32 μm. Drying is performed at 143° C. for 40 minutes, thereby forming a charge transport layer. Thus, a desired electrophotographic photoreceptor is obtained. The electrophotographic photoreceptor obtained in this manner is designated as Photoreceptor 1.

(PC-1)

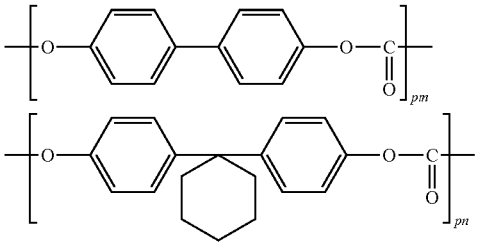

Photoreceptor 1 is obtained through the above processes.

The electrostatic capacitance per unit area of an undercoat layer of the obtained photoreceptor is measured by using the above-described method, and the results are shown in Table 1 below.

Photoreceptor 2

Photoreceptor 2 is prepared in the same manner as in the preparation of Photoreceptor 1 except that the used metal oxide particle in forming the undercoat layer in Photoreceptor 1 is changed to zinc oxide (volume average particle diameter: 70 nm, manufactured by Tayca Corporation, and BET specific surface area: 19 m$^2$/g), and an added amount of the silane coupling agent (KBM603 manufactured by Shin-Etsu Chemical Co., Ltd.) is changed to 0.75 parts by weight.

The electrostatic capacitance per unit area of an undercoat layer of the obtained photoreceptor is measured by using the above-described method, and the results are shown in Table 1 below.

Photoreceptor 3

Photoreceptor 3 is prepared in the same manner as in the preparation of Photoreceptor 1 except that the used metal oxide particle in forming the undercoat layer in Photoreceptor 1 is changed to zinc oxide (volume average particle diameter: 70 nm, manufactured by Tayca Corporation, and BET specific surface area: 19 m$^2$/g), and the dispersion time in adjusting the coating liquid for forming an undercoat layer is changed to 8 hours.

The electrostatic capacitance per unit area of an undercoat layer of the obtained photoreceptor is measured by using the above-described method, and the results are shown in Table 1.

Photoreceptor 4

Photoreceptor 4 is prepared in the same manner as in the preparation of Photoreceptor 1 except that an amount of added silane coupling agent (KBM603 manufactured by Shin-Etsu Chemical Co., Ltd.) in forming the undercoat layer in Photoreceptor 1 is changed to 0.75 parts by weight, and the dispersion time in adjusting the coating liquid for forming an undercoat layer is changed to 6 hours.

The electrostatic capacitance per unit area of an undercoat layer of the obtained photoreceptor is measured by using the above-described method, and the results are shown in Table 1.

Photoreceptor C1

Photoreceptor C1 is prepared in the same manner as in the preparation of Photoreceptor 1 except that the dispersion time in adjusting the coating liquid for forming an undercoat layer when the undercoat layer of Photoreceptor 1 is formed is changed to 12 hours.

Photoreceptor C3

Photoreceptor C3 is prepared in the same manner as in the preparation of Photoreceptor 1 except that the used metal oxide particle in forming the undercoat layer in Photoreceptor 1 is changed to zinc oxide (volume average particle diameter: 70 nm, manufactured by Tayca Corporation, and BET specific surface area: 19 m$^2$/g), an added amount of the silane coupling agent (KBM603 manufactured by Shin-Etsu Chemical Co., Ltd.) is changed to 0.75 parts by weight, and the dispersion time in adjusting the coating liquid for forming an undercoat layer is changed to 9 hours.

Evaluation

Evaluation of Image Defect (Poor Image Density) due to Poor Transfer

The photoreceptor shown in Table 1 each is mounted in an image forming apparatus (Copying machine: Versant80Press manufactured by Fuji Xerox Co., Ltd.). A transfer voltage is set to cause the primary transfer current value to have a value as shown in Table 1. An A3 image having an image density of from 10% to 90% is formed on 10 pieces under an environment of a process speed of 525 mm/sec, a temperature of 10° C., and a humidity of 15%. Then, tone properties of the 10th image are evaluated.

Specifically, images having an image density falling in the range of from 10% to 90% in increments of 10% are formed on A3 paper, and the tone properties are evaluated based on the following criteria. The image density is measured by X-Rite404 (manufactured by X-Rite Corp.). The evaluation criteria are as follows, and the results are shown in Table 1.

Evaluation Criteria of Poor Image Density

G1: a difference between a target image density and an image density of an actually formed image is less than 10%

G2: a difference between a target image density and an image density of an actually formed image is equal to or more than 10% and less than 30%

G3: a difference between a target image density and an image density of an actually formed image is 30% or more Evaluation of Occurrence of Ghost The photoreceptor shown in Table 1 each is mounted in an image forming apparatus (Copying machine: Versant80Press manufactured by Fuji Xerox Co., Ltd.). A transfer voltage is set to cause the primary transfer current value to have a value as shown in Table 1. The following image (ghost chart) is formed on 10 pieces under an environment of a process speed of 525 mm/sec, a temperature of 20° C., and a humidity of 50%. Then, the 10th image is visually confirmed, and the occurrence of ghost is evaluated based on the following evaluation criteria.

The "ghost chart" specifically means one piece of an image obtained in such a manner that a cross image having an image density of 100% is formed at the first cycle at a photoreceptor cycle pitch, a white image having an image density of 0% is formed at the second cycle, and a half-tone image having an image density of 50% is formed at the third cycle on paper of A3. Density unevenness on the half-tone image (image at the third cycle) in the 10th sheet of the ghost chart is visually observed.

Evaluation Criteria of Occurrence of Ghost

G1: no occurrence or difficulty in recognition

G2: ghost, which is capable of being recognized when observed sufficiently, occurs, but it is in an allowable range G3: ghost occurs to such an extent that it is capable of being recognized clearly, and it is outside of the allowable range

TABLE 1

| | | Undercoat layer | | | | | Evaluation | |
|---|---|---|---|---|---|---|---|---|
| | Photoreceptor | BET specific surface area ($m^2/g$) | Amount of added silane coupling agent (part by weight) | Dispersion time (hr) | Electrostatic capacitance per unit area ($F/cm^2$) | Primary transfer current value (μA) | Poor density | Ghost |
| Example 1 | Photoreceptor 1 | 15 | 1.25 | 4 | $7.5 \times 10^{-11}$ | 120 | G1 | G1 |
| Example 2 | Photoreceptor 2 | 19 | 0.75 | 4 | $2.0 \times 10^{-10}$ | 120 | G1 | G1 |
| Example 3 | Photoreceptor 3 | 19 | 1.25 | 8 | $1.2 \times 10^{-10}$ | 120 | G1 | G1 |
| Example 4 | Photoreceptor 4 | 15 | 1.75 | 6 | $3.0 \times 10^{-11}$ | 120 | G2 | G1 |
| Example 5 | Photoreceptor 1 | 15 | 1.25 | 4 | $7.5 \times 10^{-11}$ | 160 | G1 | G2 |
| Comparative Example 1 | Photoreceptor C1 | 15 | 1.25 | 12 | $5.0 \times 10^{-10}$ | 120 | G1 | G3 |
| Comparative Example 2 | Photoreceptor 1 | 15 | 1.25 | 4 | $7.5 \times 10^{-11}$ | 79 | G3 | G1 |
| Comparative Example 3 | Photoreceptor C3 | 19 | 0.75 | 9 | $4.0 \times 10^{-10}$ | 120 | G1 | G3 |

Based on the above results, it is apparent that the occurrence of ghost is prevented in the examples, as compared with the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an electrophotographic photoreceptor that includes an electroconductive substrate, an undercoat layer which is provided on the electroconductive substrate and has electrostatic capacitance per unit area of from $2.5\times10^{-11}$ $F/cm^2$ to $2.5\times10^{-10}$ $F/cm^2$, and a photosensitive layer provided on the undercoat layer;

a charging unit configured to charge a surface of the electrophotographic photoreceptor;

an electrostatic latent image forming unit configured to form an electrostatic latent image on a charged surface of the electrophotographic photoreceptor;

a developing unit configured to develop the electrostatic latent image formed on the surface of the electrophotographic photoreceptor by using a developer containing a toner, so as to form a toner image;

an intermediate transfer member configured to receive on a surface thereof the toner image formed on the surface of the electrophotographic photoreceptor;

a primary transfer unit that configured to transfer the toner image formed on the surface of the electrophotographic photoreceptor, onto the surface of the intermediate transfer member, and provides a primary transfer current value of from 80 μA to 160 μA; and a secondary transfer unit configured to secondarily transfer the toner image transferred onto the surface of the intermediate transfer member, onto a surface of a recording medium.

2. The image forming apparatus according to claim 1, wherein the undercoat layer has an electrostatic capacitance of from $2.5\times10^{-11}$ $F/cm^2$ to $1.5\times10^{-10}$ $F/cm^2$.

3. The image forming apparatus according to claim 1, wherein the undercoat layer has an electrostatic capacitance of from $5.0\times10^{-11}$ $F/cm^2$ to $1.5\times10^{-10}$ $F/cm^2$.

4. The image forming apparatus according to claim 1, wherein the primary transfer current value of the primary transfer unit is from 80 μA to 120 μA.

5. The image forming apparatus according to claim 1, wherein the undercoat layer contains a binder resin, a metal oxide particle, and an electron accepting compound.

6. The image forming apparatus according to claim 5, wherein the metal oxide particle includes at least one selected from the group consisting of a tin oxide particle, a titanium oxide particle, and a zinc oxide particle.

7. The image forming apparatus according to claim 5, wherein a volume average primary particle diameter of the metal oxide particles is from 10 to 100 nm.

8. The image forming apparatus according to claim 5, wherein the metal oxide particle is treated with at least one coupling agent.

9. The image forming apparatus according to claim 8, wherein the coupling agent includes at least one selected from the group consisting of a silane coupling agent, a titanate coupling agent, and an aluminum coupling agent.

10. The image forming apparatus according to claim 5, wherein the electron accepting compound is an electron accepting compound which has an anthraquinone skeleton.

11. The image forming apparatus according to claim 10, wherein the electron accepting compound which has the anthraquinone skeleton is a compound represented by the following formula (1):

Formula (1)

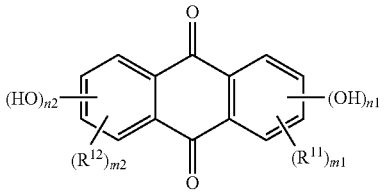

wherein n1 and n2 each independently represent an integer of 0 to 3, with the proviso that at least one of n1 and n2 represents an integer of 1 to 3; m1 and m2 each independently represent an integer of 0 or 1; and $R^{11}$ and $R^{12}$ each independently represent an alkyl group having 1 to 10 carbon atoms, or an alkoxy group having 1 to 10 carbon atoms.

12. The image forming apparatus according to claim 1, wherein a thickness of the undercoat layer is from 15 μm to 35 μm.

13. The image forming apparatus according to claim 1, wherein the image forming apparatus is configured to transport the recording medium at a speed of from 400 mm/s to 600 mm/s at the time when the recording medium contacts the intermediate transfer member for transferring the toner image onto the surface of the recording medium.

* * * * *